US006755140B2

(12) United States Patent
Sakakibara et al.

(10) Patent No.: US 6,755,140 B2
(45) Date of Patent: Jun. 29, 2004

(54) SEWING APPARATUS

(75) Inventors: Kaoru Sakakibara, Nagoya (JP); Akira Kaiya, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/648,308

(22) Filed: Aug. 27, 2003

(65) Prior Publication Data

US 2004/0040483 A1 Mar. 4, 2004

(30) Foreign Application Priority Data

Aug. 30, 2002 (JP) ..... 2002-252528

(51) Int. Cl.[7] ..... D05B 19/12
(52) U.S. Cl. ..... 112/470.01; 112/225; 112/270
(58) Field of Search ..... 112/470.01, 220, 112/225, 270, 302, 224

(56) References Cited

U.S. PATENT DOCUMENTS 5,086,718 A * 2/1992 Ogawa ..... 112/225
5,092,257 A * 3/1992 Ogawa ..... 112/225

FOREIGN PATENT DOCUMENTS

| | | |
|---|---|---|
| JP | 2002-91558 | 3/2002 |
| JP | 2002-225245 | 8/2002 |

* cited by examiner

*Primary Examiner*—Peter Nerbun
(74) *Attorney, Agent, or Firm*—Ollif & Berridge, PLC

(57) ABSTRACT

A sewing apparatus such as a household sewing machine includes a needle bar on which a sewing needle is mounted, a needle bar vertically moving mechanism vertically moving the needle bar, a thread cassette having a thread accommodating section accommodating a supply of thread, a cassette mount to which the thread cassette is detachably attached, a threading mechanism operated in synchronization with attachment of the thread cassette to the cassette mount when the needle bar is stopped at a predetermined position, the threading mechanism passing the thread drawn from the thread cassette through an eye of the needle mounted on the needle bar, and a threading limiting unit limiting the threading mechanism so that the threading mechanism is inoperative in a case where the thread cassette is attached to the cassette mount when the apparatus is disconnected from a power supply.

8 Claims, 21 Drawing Sheets

FIG. 12A
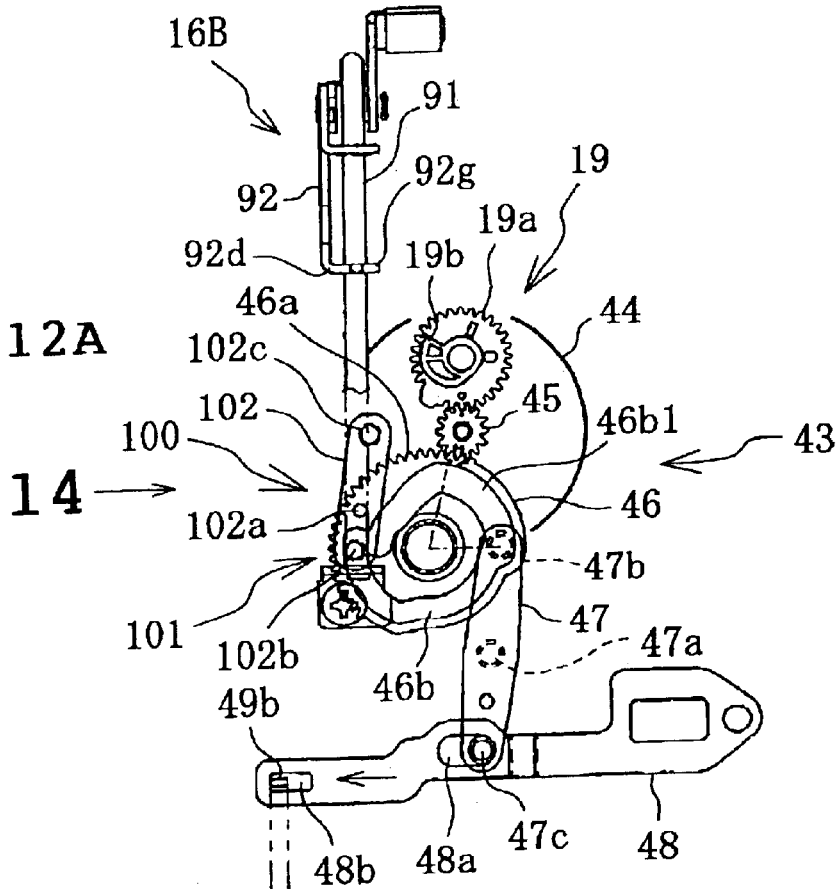
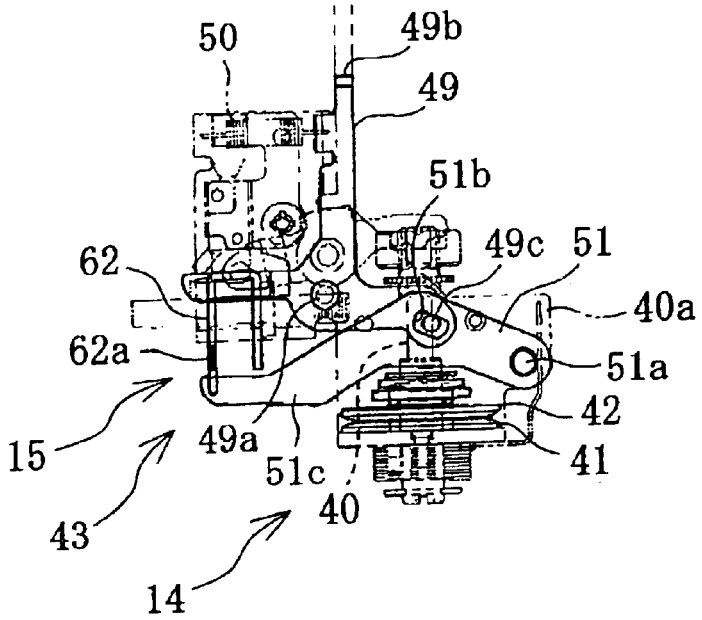
FIG. 12B

SEWING APPARATUS

BACKGROUND OF THE INVENTION

1. Field of the Invention

This invention relates generally to a sewing apparatus with a cassette mount to which a thread cassette is detachably attached, and more particularly to such a sewing apparatus in which a threading mechanism is rendered inoperative when the thread cassette is attached to the cassette mount while the apparatus is shut off.

2. Description of the Related Art

There has conventionally been proposed a sewing apparatus which includes a cassette mount to which a thread cassette accommodating a thread spool is detachably attached and in which a thread drawn from the thread cassette serves as a needle thread. In the sewing apparatus, the thread drawn from the thread cassette attached to the cassette mount is caught between a pair of thread tension discs of a thread tensioning mechanism. The thread extending downstream from the thread tension discs is caught on a needle thread take-up lever, and the thread extending downstream from the lever is passed through an eye of a sewing needle mounted on a needle bar.

The assignee of this application filed a Japanese patent application assigned with Application No. 2002-91558 and relating to a sewing apparatus including a thread carrying mechanism and a threading mechanism each operated in synchronization with attachment of the thread cassette to the cassette mount. The thread drawn from the thread cassette is automatically passed through the needle eye by the thread carrying mechanism and threading mechanism. In the disclosed sewing apparatus, the thread drawn from the thread cassette is caught and carried near the needle eye by the thread carrying mechanism, and the carried thread is caught by the threading mechanism to be passed through the needle eye.

In the above-described threading mechanism, a threading shaft is descended to be positioned relative to a needle bar. The threading shaft is rotated so that a threading hook is passed through a needle eye. A thread drawn from the thread cassette is carried near the needle eye by a thread carrying mechanism. The thread is caught on a distal end of the threading hook having been passed through the needle eye. The threading shaft is then rotated in the opposite direction so that the threading hook is returned through the needle eye. As a result, the thread is passed through the needle eye.

In the above-described sewing apparatus, a needle bar vertically moving mechanism is vertically moved. However, in order that passing the thread through the needle eye by the threading mechanism may be realized, the thread cassette needs to be attached to the cassette mount and the threading mechanism needs to be operated while the needle bar is stopped at a predetermined vertical position so that the needle eye is prevented from entering the interior of the sewing bed.

A needle bar rocking mechanism is provided for rocking the needle bar in the foregoing sewing apparatus. The needle bar is supported on a needle bar mount to be vertically moved. The needle bar mount is mounted on a frame so as to pivot about a horizontal axis. The threading mechanism is provided on the needle bar mount so as to be rocked together with the needle bar. The thread carrying mechanism is provided on the frame on which the needle bar mount is pivotally mounted. The thread carrying mechanism is not rocked in such a manner as the needle bar or the threading mechanism.

Accordingly, positional relations between the thread carrying mechanism and the needle bar and threading mechanism vary. The varied positional relations further vary the percentage of success in passing the thread through the needle eye by the threading mechanism. A zigzag position of the needle bar is previously set to improve the success percentage. In order that passing the thread through the needle eye by the threading mechanism may be realized, the needle bar needs to be stopped at a predetermined vertical position as described above and moreover, the thread cassette needs to be attached to the cassette mount and the threading mechanism needs to be operated while the needle bar is stopped at a predetermined vertical position.

The needle bar vertically moving mechanism and the needle bar rocking mechanism are operable when electric power is being supplied to the sewing apparatus. Accordingly, the needle bar can automatically be moved to a suitable position (a predetermined vertical position or predetermined zigzag position) for the attachment of the thread cassette to the cassette mount. Or, when the vertical position of the needle bar is unsuitable for threading, informing the user of that is suggested for the purpose of preventing attachment of the thread cassette to the cassette mount.

However, when the sewing apparatus is disconnected from the power supply or is forgotten to be connected to the power supply, for example, the needle bar cannot be moved to a predetermined position by the needle bar vertically moving mechanism and threading mechanism or informing cannot be carried out. As a result, there is a possibility that the thread cassette may be attached to the cassette mount while the needle bar is stopped at a position other than the predetermined one.

Thus, the threading mechanism is operated in synchronization with the attachment of the thread cassette in the foregoing sewing apparatus. Accordingly, in a case where the thread cassette is erroneously attached to the cassette mount during shutoff from power supply, the threading mechanism is operated even when the needle bar is stopped at a position other than the predetermined one. Consequently, the threading mechanism may be damaged or other failure may occur. As the other failure, for example, the sewing machine cannot be threaded since the needle bar is not stopped at the predetermined position. Nevertheless, the thread is uselessly drawn from the thread cassette by the threading hook and the thread carrying mechanism when the threading mechanism is operated. It is time-consuming to rewind the drawn thread onto the thread spool in the thread cassette.

SUMMARY OF THE INVENTION

Therefore, an object of the present invention is to provide a sewing apparatus in which the threading mechanism is not operated in a case where the thread cassette is attached to the cassette mount when the apparatus is disconnected from the power supply, thereby preventing any disadvantage due to inadvertent operation of the threading mechanism during disconnection from the power supply.

The present invention provides a sewing apparatus comprising a needle bar on which a sewing needle is mounted, a needle bar vertically moving mechanism vertically moving the needle bar, a thread cassette having a thread accommodating section accommodating a supply of thread, a cassette mount to which the thread cassette is detachably attached, a threading mechanism operated in synchronization with attachment of the thread cassette to the cassette mount when the needle bar is stopped at a predetermined position, the threading mechanism passing the thread drawn from the thread cassette through an eye of the needle mounted on the needle bar, and a threading limiting unit limiting the threading mechanism so that the threading mechanism is inoperative in a case where the thread cassette is attached to the cassette mount when the apparatus is disconnected from a power supply.

In the above-described sewing apparatus, the threading mechanism is operated in synchronization with attachment of the thread cassette to the cassette mount when electric power is being supplied to the apparatus. In a case where the threading mechanism is operated when the needle bar is stopped at the predetermined position, the thread drawn from the thread cassette attached to the cassette mount is passed through the eye of the needle mounted to the needle bar. Furthermore, while electric power is being supplied to the apparatus, the threading mechanism is limited by the threading limiting unit so that the threading mechanism is inoperative, although the needle bar cannot automatically be moved to the predetermined position by the needle bar vertically moving mechanism and an alarming or informing operation cannot be performed.

In a preferred form, the sewing apparatus further comprises a needle bar rocking mechanism for rocking the needle bar and a needle bar movement controlling unit controlling the needle bar vertically moving mechanism and the needle bar rocking mechanism so that the needle bar is moved to the predetermined position in a case where the thread cassette has been detached from the cassette mount while electric power is being supplied to the apparatus. In this case, the needle bar movement controlling unit may control only the needle bar vertically moving mechanism.

In another preferred form, the threading mechanism includes a moving member provided on the cassette mount, the moving member being thrust by the thread cassette attached to the cassette mount thereby to be moved from an initial position so that the threading mechanism is operated, and the threading mechanism includes a holding unit holding the moving member at a standby position where the threading mechanism is inoperative even when the moving member is thrust by the thread cassette being attached to the cassette mount.

In further another preferred form, the holding unit includes a stopper engaging the moving member located at the standby position to hold the moving member at the standby position, an actuator switching between an engagement position where the stopper engages the moving member and a non-engagement position where the stopper is disallowed to engage the moving member, and a control unit controlling the actuator.

In the above-described construction, the actuator preferably comprises a pulse motor provided in the needle bar vertically moving mechanism for rocking the needle bar, and the threading limiting unit preferably limits the threading mechanism so that the stopper is located at the non-engagement position when the needle bar is located at the predetermined position and so that the stopper is located at the engagement position when the needle bar is located at a position other than the predetermined position.

In the above-described construction, the pulse motor preferably also serves to open and close a thread tension disc applying a tension to the thread drawn from the thread cassette, and the thread tension disc is preferably opened when the needle bar is located at the predetermined position and closed when the needle bar is located at a position other than the predetermined position.

In further another preferred form, the sewing apparatus further comprises a thread carrying mechanism operated in synchronization with attachment of the thread cassette to the cassette mount when the needle bar is stopped at the predetermined position, thereby carrying the thread from the thread cassette to a position near an eye of the needle mounted on the needle bar, and a limiting unit limiting the threading mechanism and the thread carrying mechanism so that both the threading mechanism and the thread carrying mechanism are inoperative in a case where the thread cassette is attached to the cassette mount when the apparatus is disconnected from a power supply.

BRIEF DESCRIPTION OF THE DRAWINGS

Other objects, features and advantages of the present invention will become clear upon reviewing the following description of embodiment, made with reference to the accompanying drawings, in which:

FIGS. 12A and 12B are front and plan views of a thread tensioning mechanism in a closed state respectively;

DETAILED DESCRIPTION OF THE INVENTION

Figure 1:
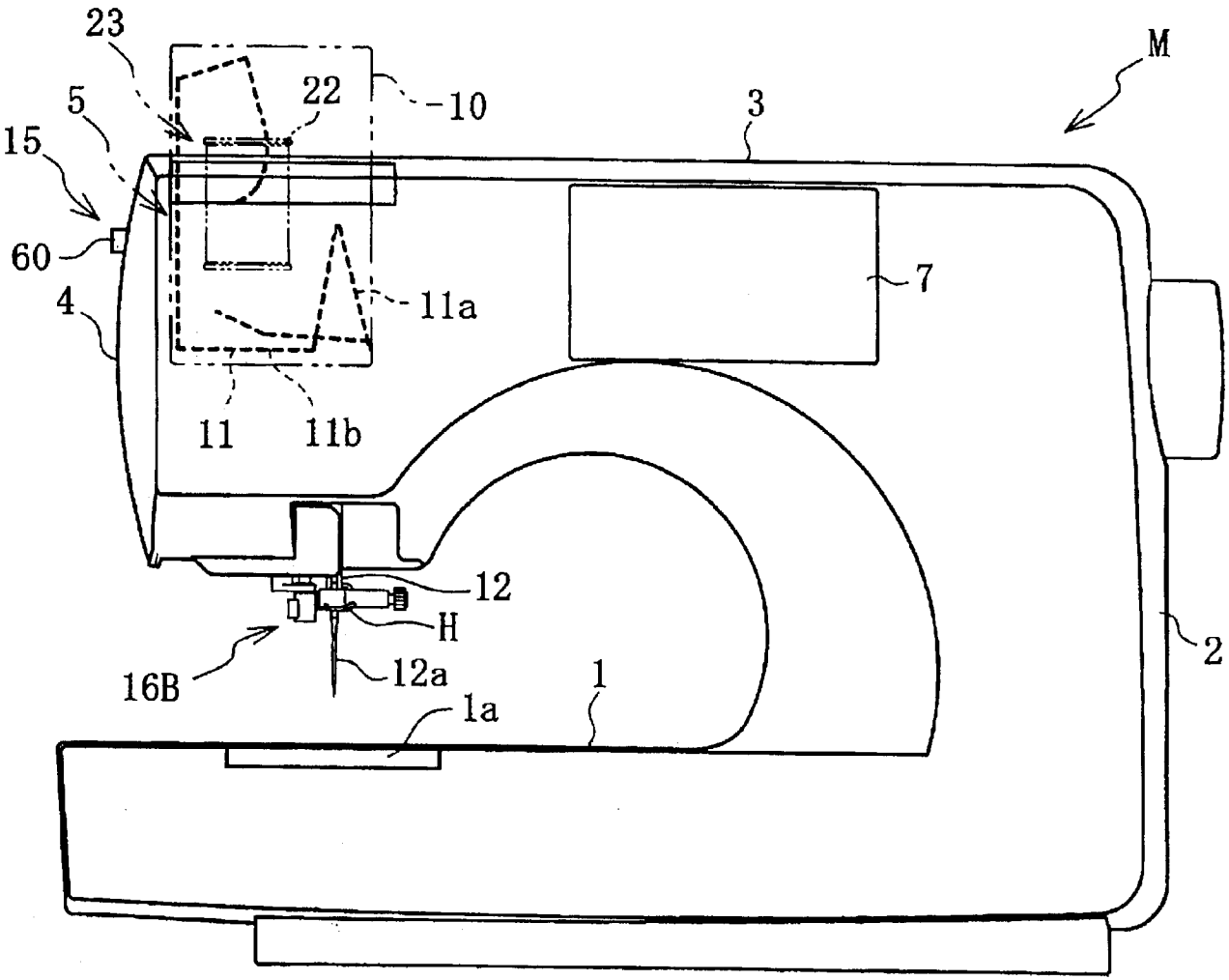
FIG. 1 is a front view of a sewing machine in accordance with one embodiment of the present invention during attachment of a thread cassette to a cassette mount.

One embodiment of the present invention will be described with reference to the accompanying drawings. The invention is applied to a household sewing machine provided with a cassette mount to which a thread cassette having a thread accommodating section for accommodating a supply of thread is detachably attached.

Referring to FIGS. 1 to 4, a household sewing machine M includes a sewing bed 1 having a horizontal bed plane, a pillar 2 standing from a right end of the bed 1, a sewing arm 3 extending leftward from an upper end of the pillar 2 so as to be opposed along the bed 1, and a machine head 4 located at a left end of the arm 3. The head 4 is provided with a cassette mount 5 to which a thread cassette 10 is detachably attached. A thread 11 drawn from the thread cassette 10 attached to the cassette mount 5 serves as a needle thread. The arm 3 or the head 4 thereof includes operation switches 6 (see FIG. 15) such as a sewing start switch, sewing finish switch, etc. The arm 3 further includes a liquid crystal display 7 and a touch panel 8 provided on the surface of the liquid crystal display.

Referring to FIGS. 2, 4, 9 and 10, in the head 4 are provided a needle bar 12, a needle thread take-up lever 13, a thread tensioning mechanism 14 adjusting a thread tension of the needle thread drawn from the thread cassette 10 attached to the cassette mount 5. In the head 4 are further provided a cassette detaching mechanism 15 rendering the thread cassette 10 detachable from the cassette mount 5 when a detaching operation member 60 is operated. The head 4 further includes a threading section 16*c* (a thread carrying mechanism 16A and a threading mechanism 16B) and a needle bar threading mechanism 17 all of which are operated in synchronization with attachment of the thread cassette 10 to the cassette mount 5. The head 4 still further includes a needle bar vertically moving mechanism 18 for vertically moving the needle bar 12, a needle bar rocking mechanism 19 for rocking the needle bar 12, and a needle thread take-up lever driving mechanism for vertically rocking a needle thread tale-up lever 13.

The thread carrying mechanism 16A catches the thread 11 drawn from the thread cassette 10 and carries the caught thread 11 near an eye 12*b* of a sewing needle 12*a*. The threading mechanism 16B passes the thread 11 carried by the thread carrying mechanism 16A through the needle eye 12*b*. The needle bar threading mechanism 17 causes the thread 11 to be caught on a thread guide H (see FIG. 1 etc.) of the needle bar 12.

Figure 3:
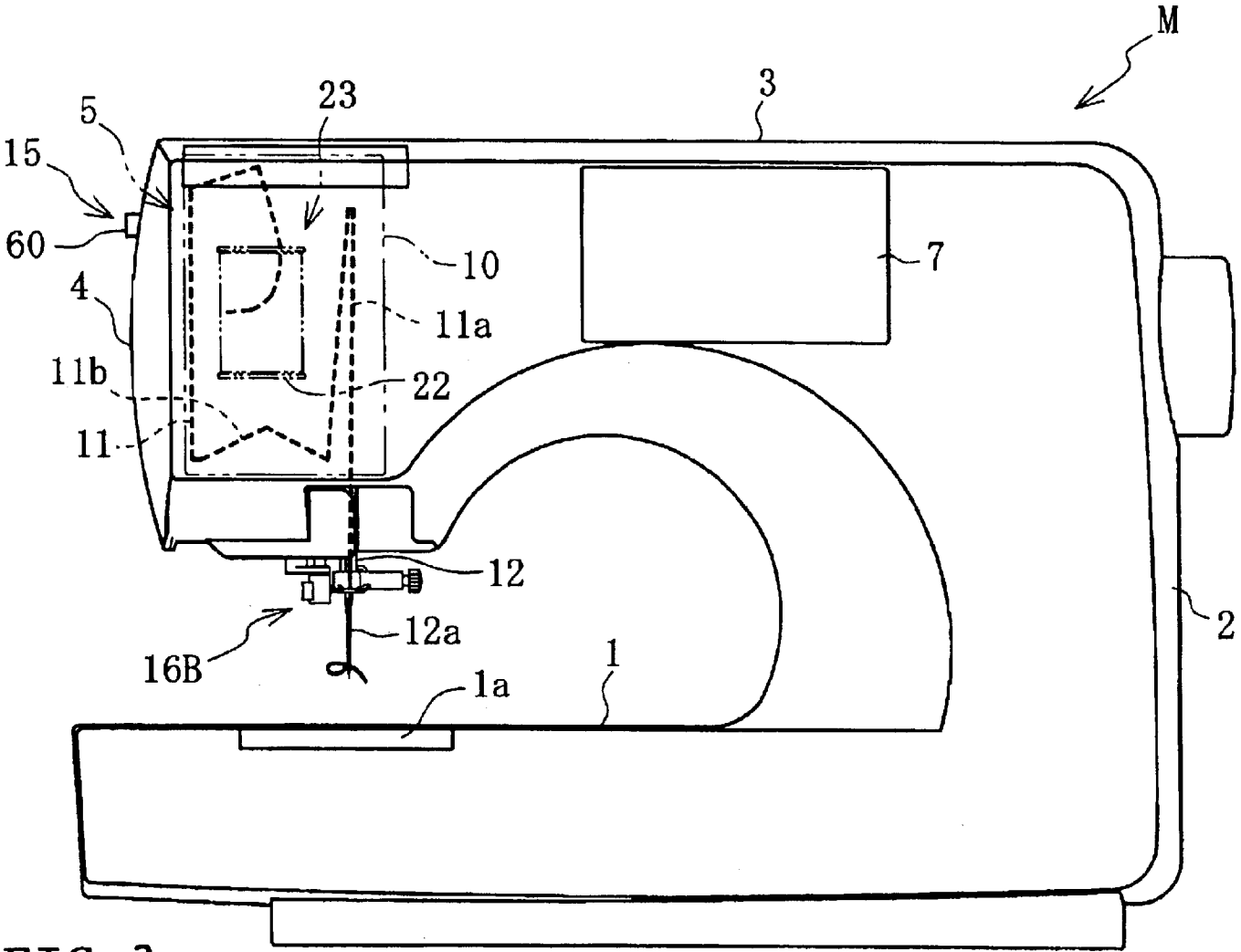
FIG. 3 is a front view of the sewing machine with the thread cassette having been attached.
Figure 4:
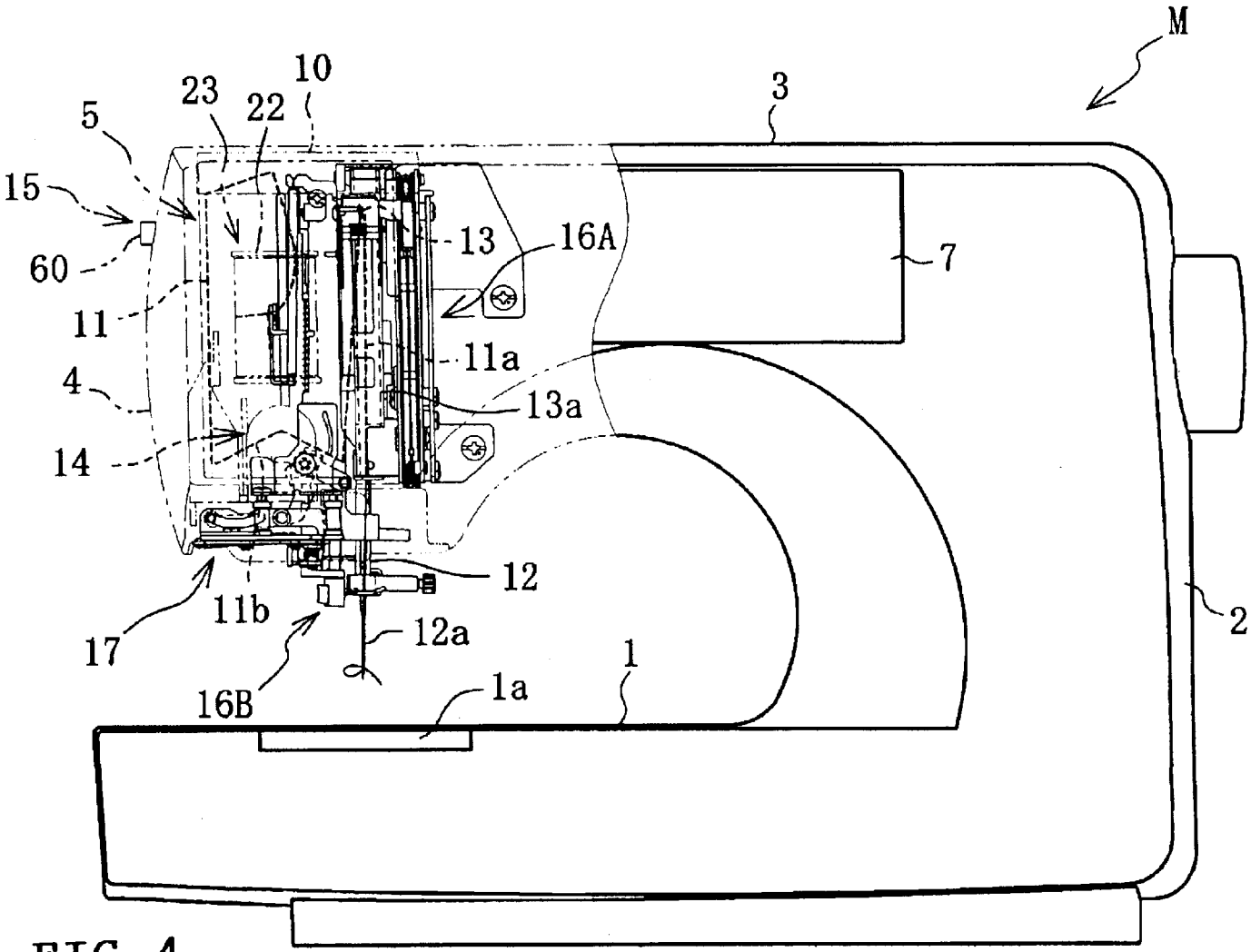
FIG. 4 is a front view of the sewing machine with the sewing head being eliminated.
Figure 5:
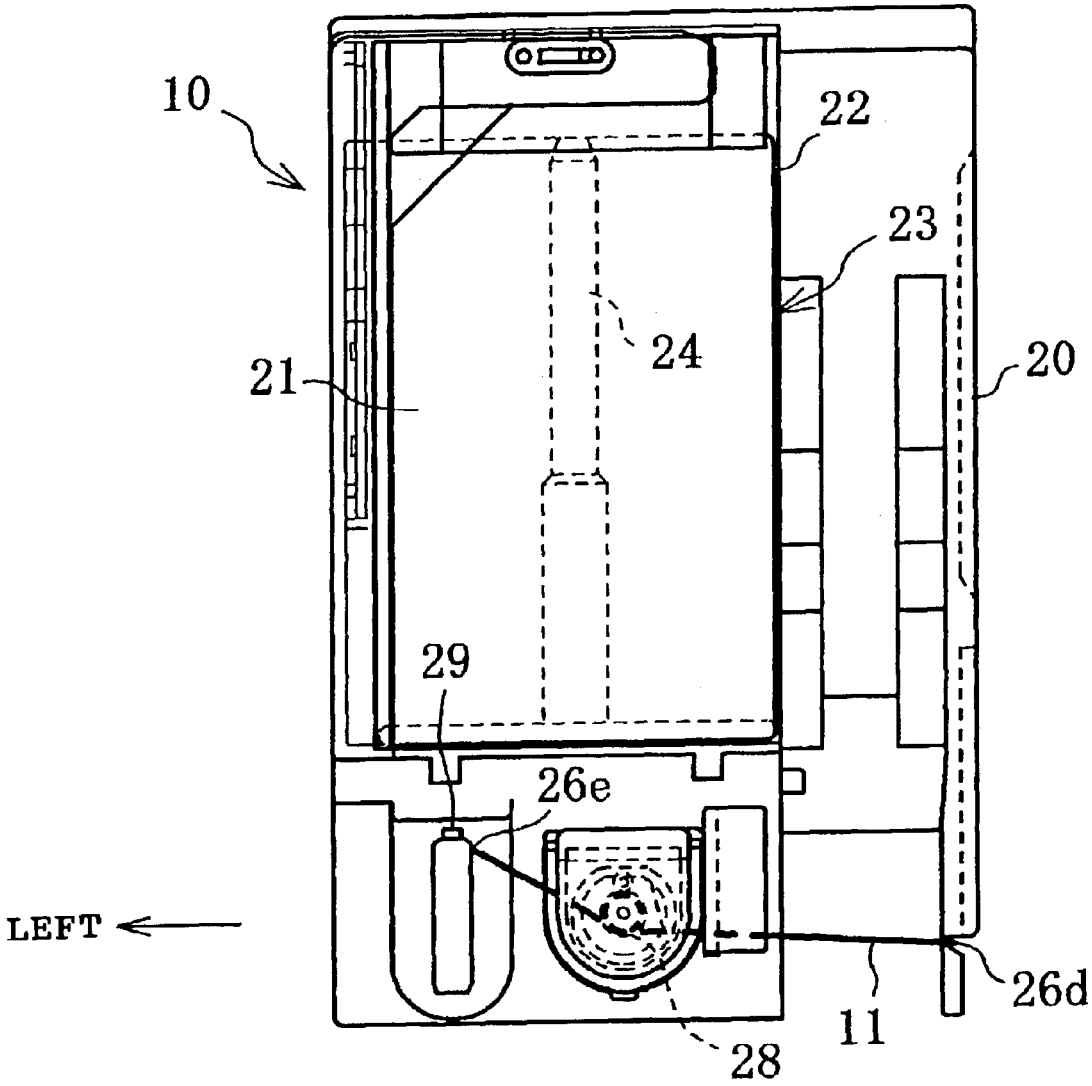
FIG. 5 is a front view of the thread cassette.
Figure 6:
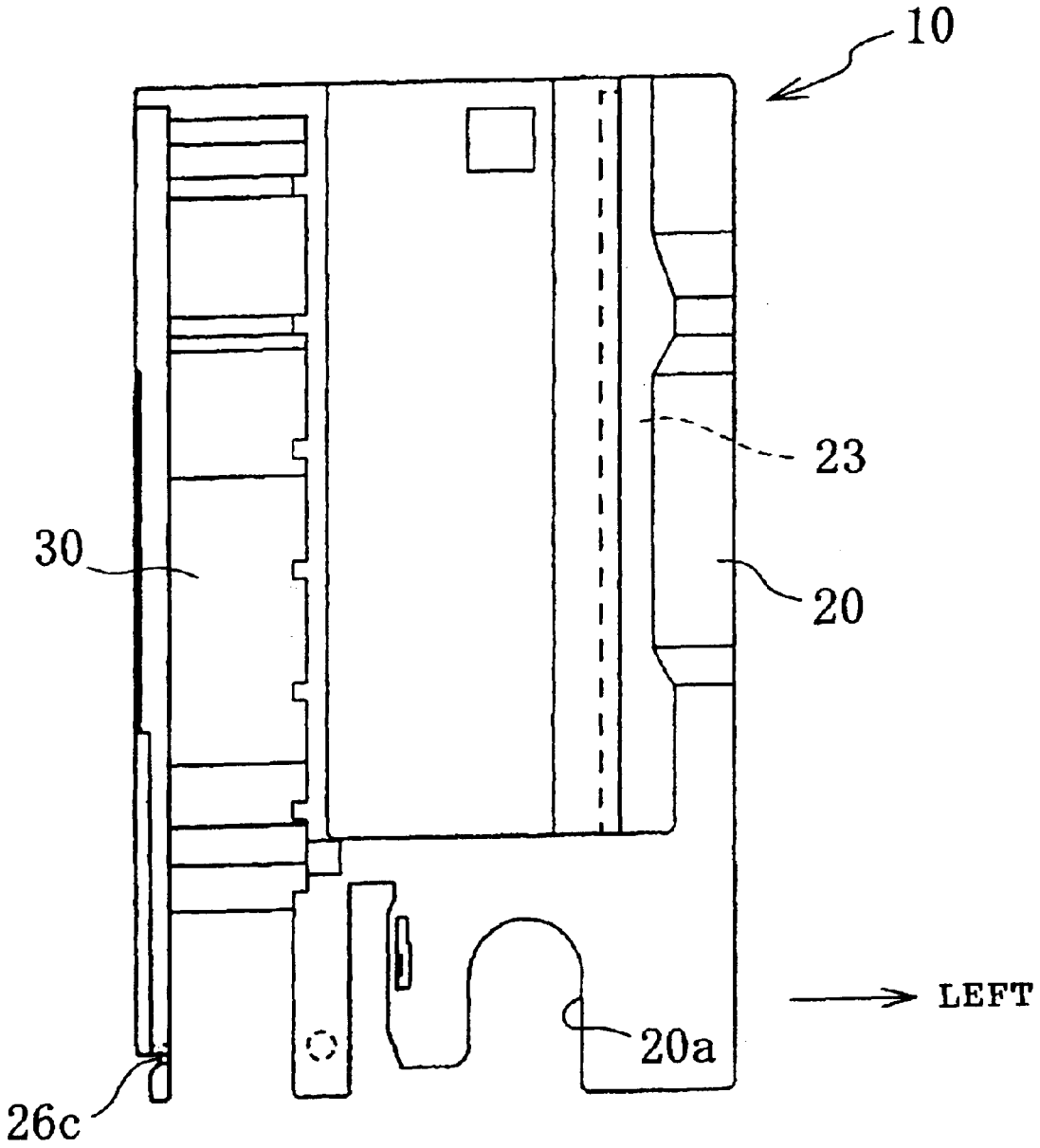
FIG. 6 is a rear view of the thread cassette.
Figure 11:
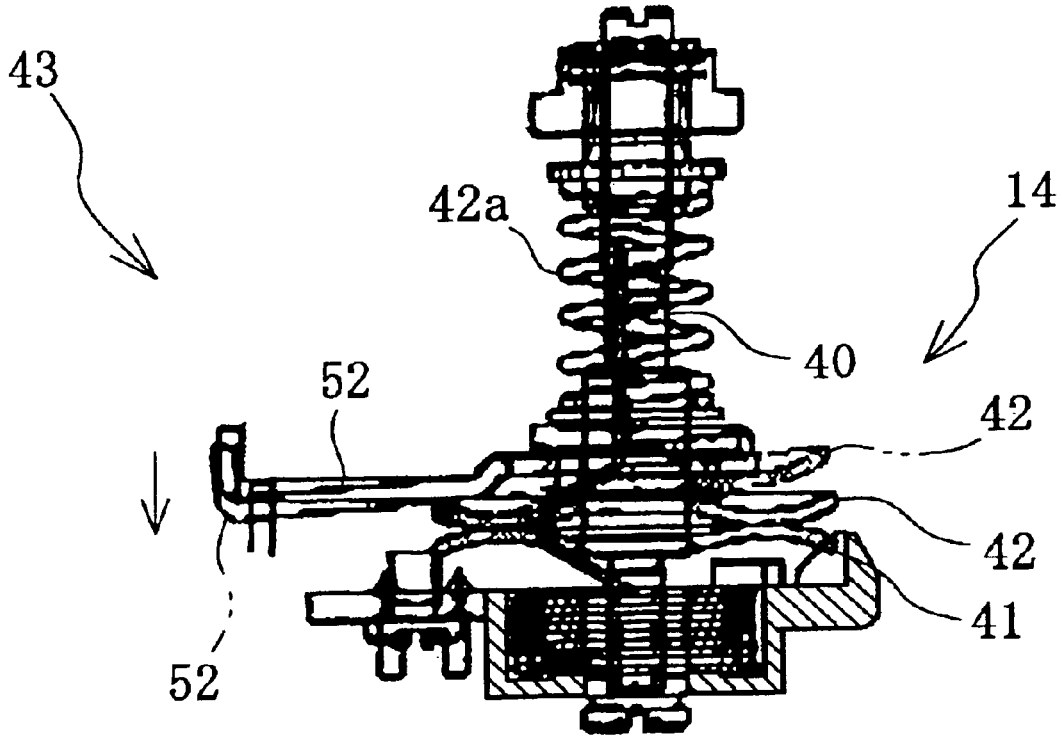
FIG. 11 is a plan view of thread tension discs of a thread tensioning mechanism.

Referring to FIGS. 3 and 4, the thread 11 drawn from the thread cassette 10 attached to the cassette mount 5 is placed on a thread tension shaft 40 (see FIG. 11) disposed between a pair of thread tension discs 41 and 42 of the thread tensioning mechanism 14 in attachment of the thread cassette 10 to the cassette mount 5. The thread 11 extending downstream from the thread tension shaft 40 is caught on the needle thread take-up lever 13. The thread 11 extending downstream from the needle thread take-up lever 13 is passed through the needle eye 12*b* (see FIG. 14), whereupon the thread 11 is set in the sewing machine M so that a sewing operation can be carried out.

The bed 1 is provided with a bobbin mount (not shown) to which a bobbin (not shown) is detachably attached. A thread drawn from the bobbin serves as a bobbin thread. The bed 1 is further provided with a shuttle mechanism (not shown). When the needle and bobbin threads are set for the sewing operation and a sewing machine motor 9 (see FIG. 19) is driven, the needle bar 12 is vertically moved by the needle bar vertically moving mechanism 18. The shuttle mechanism is driven in synchronization with the vertical movement of the needle bar 12 so that the needle thread 11 near the needle 12*a* lowered below a needle plate 1*a* of the bed 1, whereupon the needle and bobbin threads are entangled to be formed into stitches.

Figure 7:
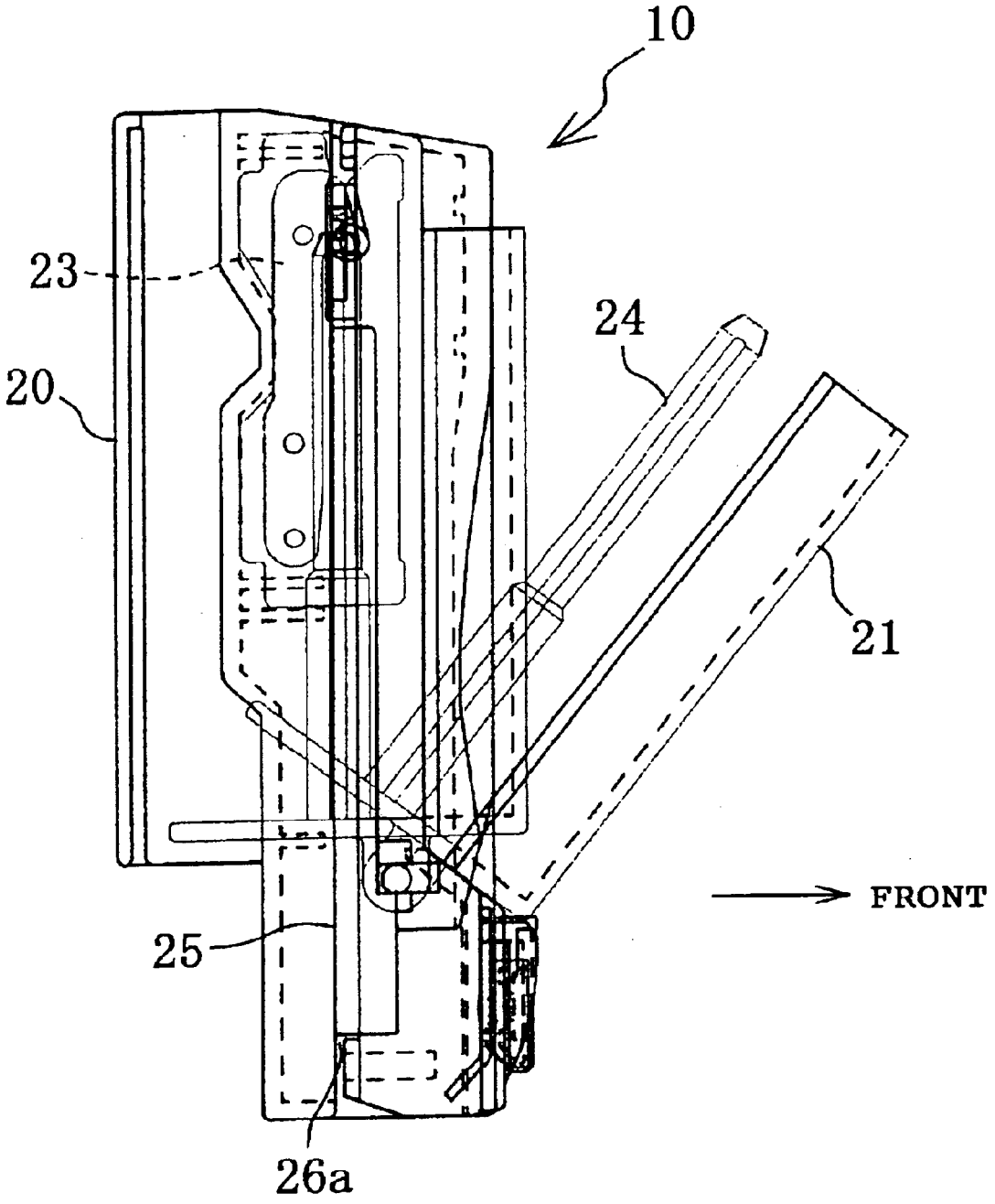
FIG. 7 is a left-hand side view of the thread cassette with the lid open.
Figure 8:
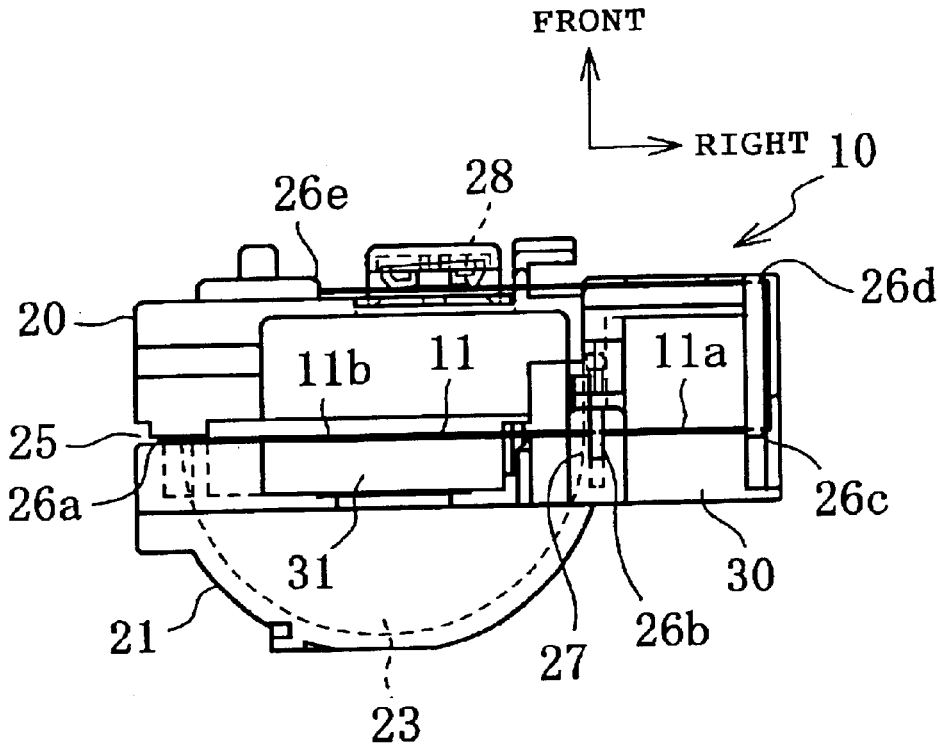
FIG. 8 is a bottom view of the thread cassette.

The thread cassette 10 will now be described. Referring to FIGS. 5 to 8, the thread cassette 10 comprises a cassette body 20 and a lid 21 pivotally mounted on the body 20. The cassette body 20 with the lid 21 defines therein a thread accommodating cavity 23 for accommodating a thread spool 22 serving as a supply of thread. A spool pin 24 is mounted on the lid 21. When the lid 21 is opened forward as shown in FIG. 7, the thread spool 22 is allowed to be attached to and detached from the spool pin 24. When the lid 21 is closed with the thread spool 22 attached to the spool pin 24, the thread spool is enclosed in the thread accommodating cavity 23.

The thread 11 extends upward from the thread spool 22 to be drawn out of the thread accommodating cavity 23. The thread 11 further extends through a thread path 35 defined between the cassette body 20 and a left-hand end of the lid 21. The thread 11 is then put on a first thread guard 26*a* at a left lower end of the thread cassette 10, further extending rightward thereafter to be put on a second thread guard 26*b* at a lower end of a partition wall 27 and a third thread guard 26*c* at a right lower end of the thread cassette 10. The thread 11 further extends forward to be put on a fourth thread guard 26*d* and is then returned to extend leftward. The thread 11 is then retained on a thread retainer 28. Furthermore, the thread 11 extending leftward is cut by a left blade 29 of the thread retainer 28 and the resultant end is put on a fifth thread guard 26*e* near the blade 29.

The thread cassette 10 is thus prepared for attachment to the cassette mount 5 as described above. A needle thread take-up lever guide space 30 defined at a right end of the thread cassette 10 extends substantially over the length of the cassette. The guide space 40 is open at the rear and the lower portion of the cassette. A thread tensioning space 31 is defined at a central lower end of the thread cassette 10 and open at a lower portion thereof. These spaces 30 and 31 are partitioned by a partition wall 27.

The thread cassette 10 is descended to be inserted into the cassette mount 5. In this case, the needle thread take-up lever 13 and a needle thread take-up lever guide 13*a* (see FIG. 2 etc.) guiding the lever enter the guide space 30 from below the cassette, whereas the thread tensioning shaft 40 of the thread tensioning mechanism 14 and a pair of thread tension discs 41 and 42 enter the thread tensioning space 31 from below the cassette. A notch 20*a* is formed in the lower end of the rear wall of the cassette body 20 to prevent the thread tensioning shaft 40 from interference with the thread cassette 10. When the thread cassette 10 has been inserted slightly into the cassette mount 5, a thread part 11*a* between the thread guards 26*a* and 26*c* is caught by the needle thread take-up lever 13 in the guide space 30.

Figure 2:
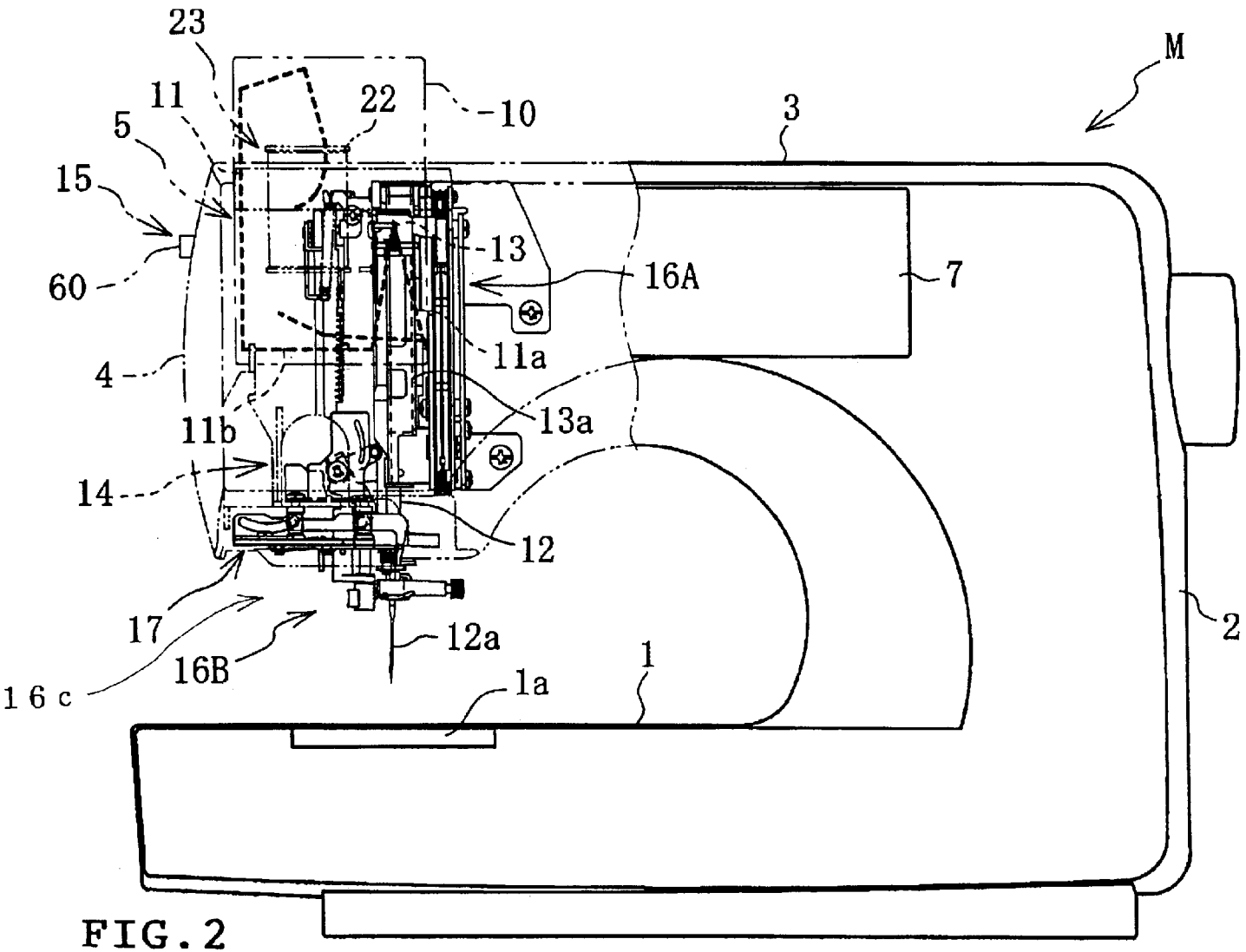
FIG. 2 is a front view of the sewing machine with the sewing head being eliminated.

Subsequently, when the thread cassette 10 is further inserted into the cassette mount 5, the thread guards 26*a* and 26*b* are descended relative to the needle thread take-up lever 13 on which a thread part 11*a* is caught. However, the thread downstream the thread part 11*a* is continuously held by the thread holding portion 28. Accordingly, the thread 11 is drawn from the thread spool 22 in the thread accommodating cavity 23. For example, the thread part 11*a* has a generally triangular shape when two thirds of the thread cassette are inserted into the cassette mount 5, as shown in FIGS. 1 and 2. When the thread cassette 10 is completely attached to the cassette mount 5, the thread part 11*b* between the thread guards 26*a* and 26*b* is caught on the thread tensioning shaft 40 between the paired thread tension discs 41 and 42 in the thread tensioning space 31.

The thread tensioning mechanism 14 will now be described. Referring to FIGS. 11 to 13B, the thread tensioning mechanism 14 includes the thread tensioning shaft 40 fixed to a frame (not shown) and extending rearward, the front thread tension disc 41 fixedly fitted with the shaft 40, the rear thread tension disc 42 fixedly fitted with the shaft 40 so as to be brought into a face-to-face contact with the front thread tension disc, and a thread tensioning spring 42*a* comprising a compression coil spring fitted with the shaft 40 so as to urge the rear disc 42 against the front disc 41. A drive mechanism 43 is provided for opening and closing the thread tension discs 41 and 42 and includes a pulse motor 44.

The drive mechanism 43 includes the pulse motor 44, a driving gear 45, a cam member 46, link members 47 and 48, a pivot link member 49, an extension coil spring 50, a thrust link member 51, and an opening lever 52. The driving gear 45 is secured to an output shaft of the pulse motor 44 and is in mesh engagement with a gear 46*a* of the cam member 46. The link member 47 has a central portion pivotally mounted on a support shaft 47*a*. The link member 47 further has an upper end with a cam follower 47*a* in engagement with a cam groove 46*b* of the cam member 46 and a lower end with a pin 47*c* in engagement with a ventral elongated hole 48*a* of the link member 48 supported so as to be moved in a right-and-left direction.

The pivot link 49 has a central portion mounted on a support shaft 49*a* so as to be pivoted about a vertical axis. The pivot link 49 is urged counterclockwise by the extension coil spring 50. The pivot link 49 has a rear end with an engagement portion 49*b* in engagement with an elongate hole 49*b* formed in a left end of the link member 48. The pivot link 49 has a right end with a pin 49*c* in engagement with a central elongate hole 51*b* of the thrust member 51. The thrust link member 51 has a right end pivotally mounted on a support shaft 51*a* so as to be pivoted about a vertical axis. The opening lever 52 is pressed against a thread tension spring 42*a*.

The thread tension discs 41 and 42 are closed when the cam follower 47*b* is in engagement with a cam groove 46*b*1 of the cam groove 46*b*, as shown in FIGS. 12A and 12B. The cam groove 46*b*1 has the same diameter as the cam groove 46*b*. The cam groove 46*b*1 spreads over about 80 degrees and maintains the cam follower 47*b* in engagement with the cam groove 46*b*1, so that the pulse motor 44 is driven in an angular range corresponding to about 80 degrees. The reason for this is that the pulse motor 44 and the driving gear 45 serve not only as the components of the needle bar rocking mechanism 19 but also as those of the drive mechanism 43. As a result, the needle bar 12 can be rocked while the thread tension discs 41 and 42 are closed. The needle bar rocking mechanism 19 includes the pulse motor 44, driving gear 45, a gear 19*a* in mesh engagement with the driving gear 45 and a cam 19*b* fixedly provided on the gear 19*a*. Rotation of the cam 19*b* produces a rocking motion of the needle bar 12.

The cam member 46 is turned clockwise upon drive of the pulse motor 44 so that the cam follower 47*b* engages the cam groove 46*b*2 of the cam groove 46. As the cam follower 47*b* moves to the central side of the cam member 46, the link members 47 and 48 and the pivot link 49 are synchronously moved in the direction of arrow. The opening lever 52 is then thrust forward by a left lever 51*c* of the forwardly moving thrusting member 51. As a result, the rear thread tension disc 42 is moved so as to be inclined such that the discs 41 and 42 are opened with a space therebetween.

Figure 9:
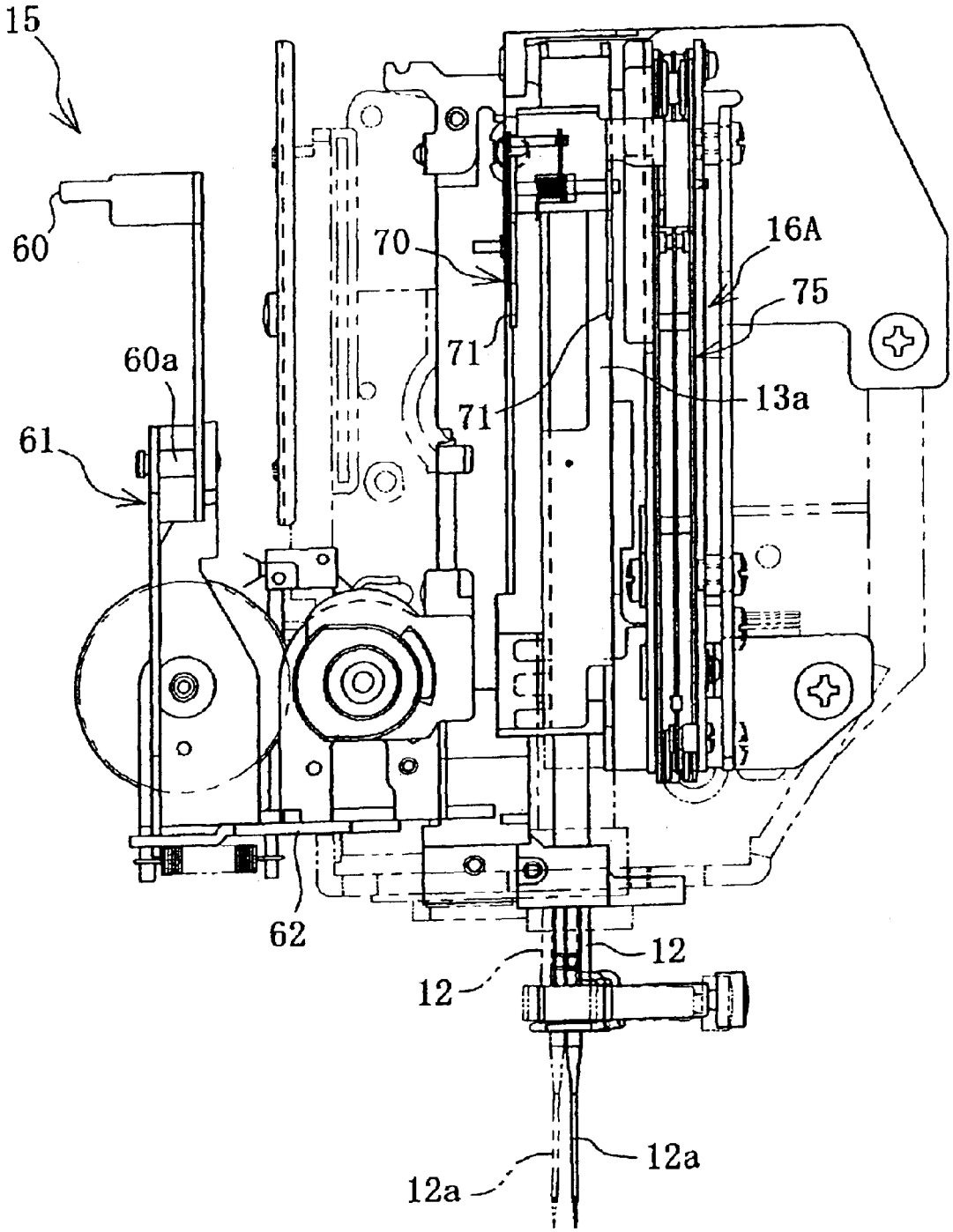
FIG. 9 is a front view of the front interior of the head.
Figure 10:
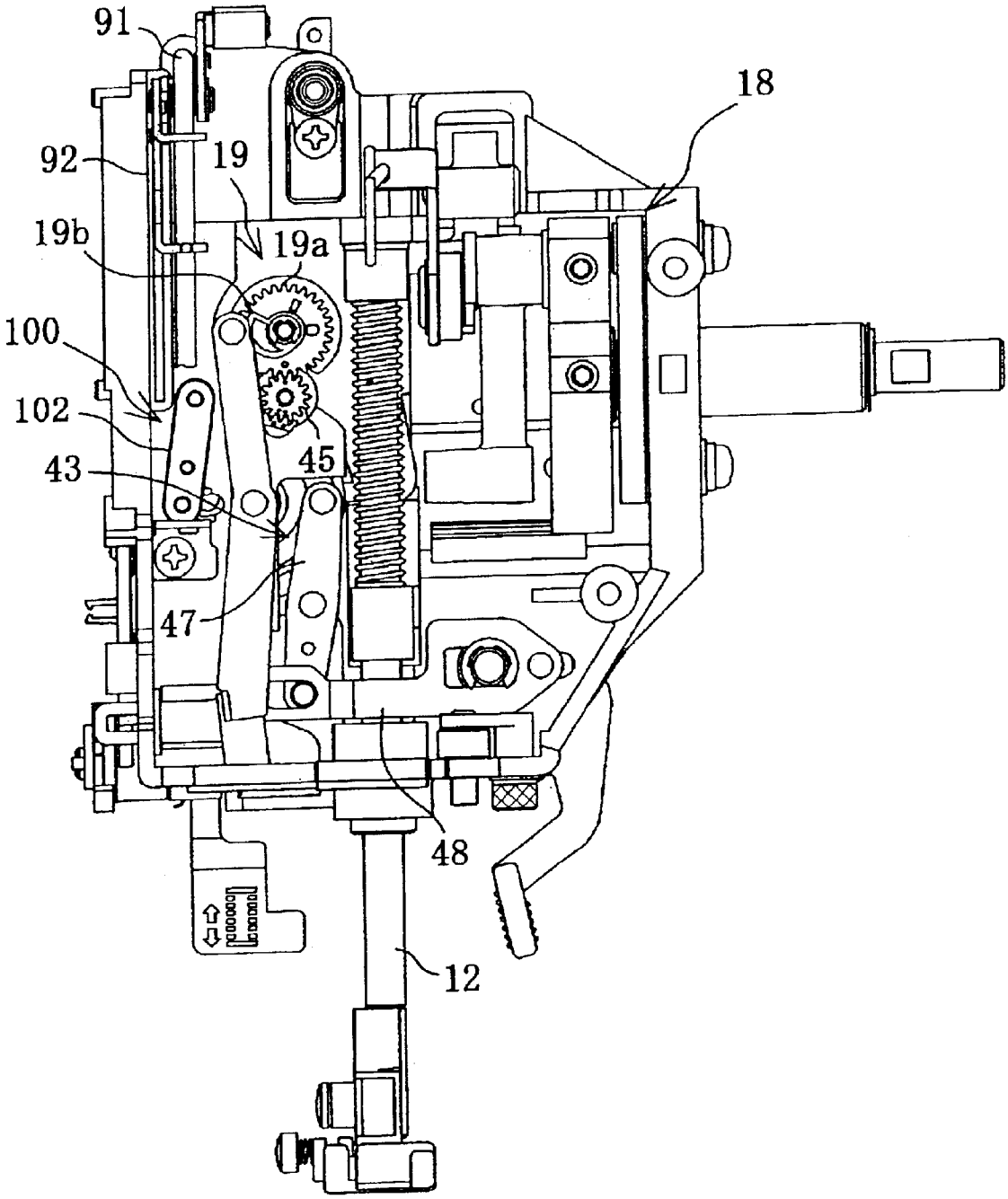
FIG. 10 is a front view of the front interior of the head in another condition.

When the thread cassette 10 is attached to the cassette mount 5 while the thread tension discs 41 and 42 are open, the part 11*b* of the thread 11 drawn from the thread cassette 10 is caught by the thread tension shaft 40 disposed between the discs 41 and 42. Successively, when the pulse motor 44 is driven so that the cam member 46 is turned counterclockwise, the urging force of the extension coil spring 50 returns the pivot link 49 to the former position. Accordingly, the thread tension discs 41 and 42 are closed by the thread tensioning spring 42*a*. The chain line in FIG. 9 shows the left needle position to which the needle bar 12 is moved while the thread tension discs 41 and 42 are open.

Figure 15:
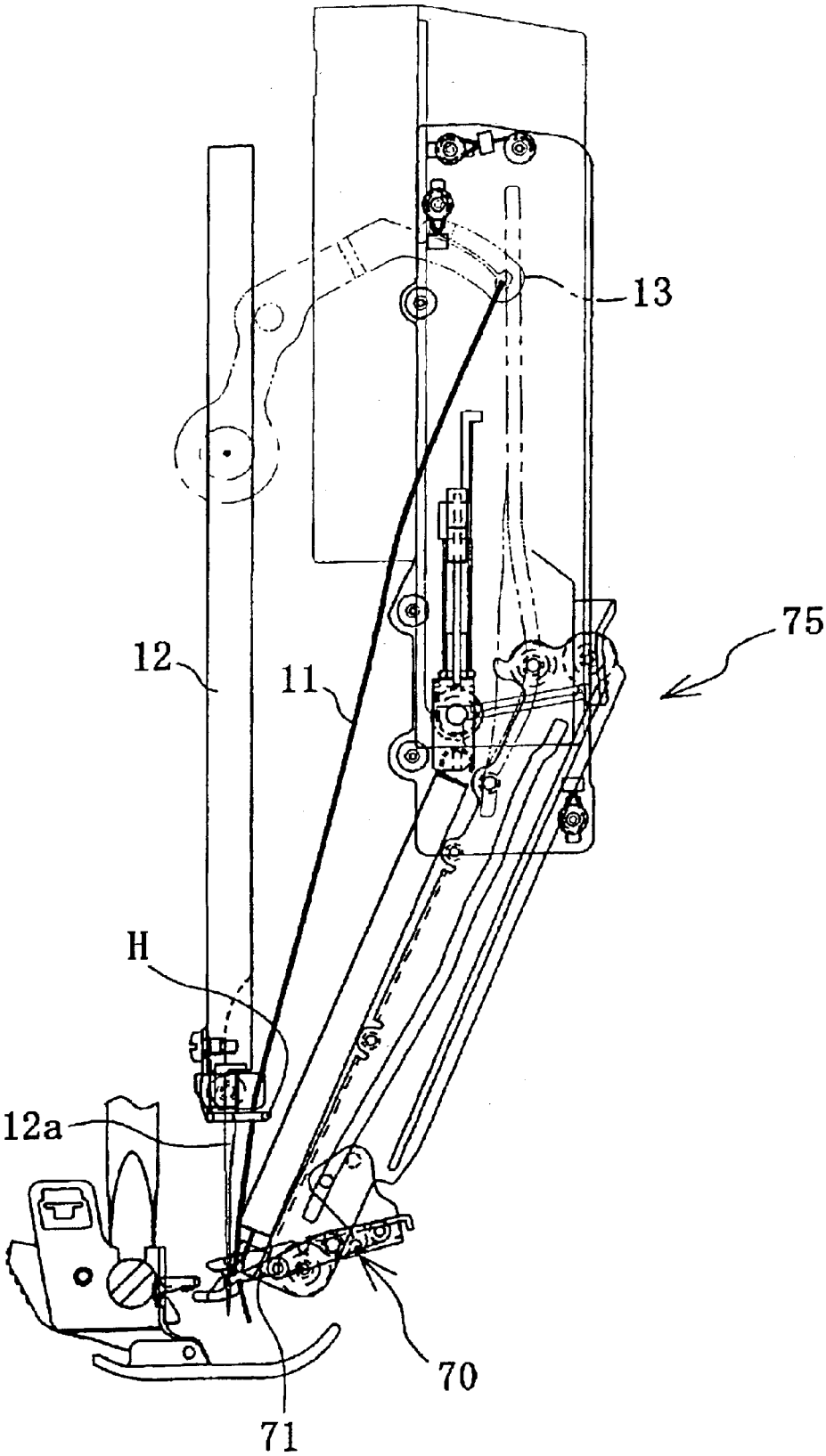
FIG. 15 a left-hand side view of a thread carrying mechanism.

The thread carrying mechanism 16A will be described. Referring to FIGS. 9 and 15, the thread carrying mechanism 16A is provided on the frame on which a needle bar base 80 (see FIGS. 16A and 16B) is pivotally mounted and includes a threading member 70 catching the thread 11 drawn from the thread cassette 10 and a threading drive mechanism section 55 lowering the threading member 70 from a standby position (see FIG. 9) while the attitude of the threading member is being changed, whereby the threading member is transferred from a threading position (not shown) toward the thread carrying position (see FIG. 15).

The threading member 70 has a pair of threading plates 71. When the threading member 70 is at the threading position, a part of the thread 11 located downstream the needle thread take-up lever 13 is caught over the paired threading plates 71 in a tight state. Furthermore, when located at the thread carrying position, the threading member 70 is positioned relative to the position of the needle bar 12 with respect to the vertical position thereof, and the needle thread 12*a* is located between the threading plates 71, whereupon the thread 11 is close to the needle eye 12*b*. Japanese patent application Nos. 2002-91558 and 2002-225245 both filed by the assignee of the present application disclose the above-described thread carrying mechanism and the threading member 70 in detail.

The threading mechanism 16B will be described. Referring to FIGS. 16A, 16B, 17A and 17B, the threading mechanism 16B is mounted on the needle bar base 80 and includes a threading shaft 81 and slider guide shaft 82 supported on the needle bar base 80 on the left of the needle bar 12 so as to be vertically moved, a threading slider 83 fitted with upper portions of these shafts 81 and 82 so as to be vertically moved, and a hook mechanism section 84 mounted on a lower end of the threading shaft 81.

The threading shaft 81 has two pins 85*a* and 85*b* protruding from an upper portion thereof. The upper pin 85*a* is in engagement with a spiral engagement groove 83*a* formed in the threading slider 83, whereas the lower pin 85*b* is engageable, from above, with the engaging member 12*c* fitted with the needle bar 12. A compression coil spring 86 is provided around the threading shaft 81 to urge the slider 83 upward relative to the threading shaft, whereby the pin 85*a* usually engages a lower end of the engagement groove 83*a*. Furthermore, another compression coil spring 87 is provided around the slider guide shaft 82 to urge the threading slider 83 upward, whereby the threading shaft 81 and the threading slider 83 are usually located at respective upper limit positions.

Figure 16A:
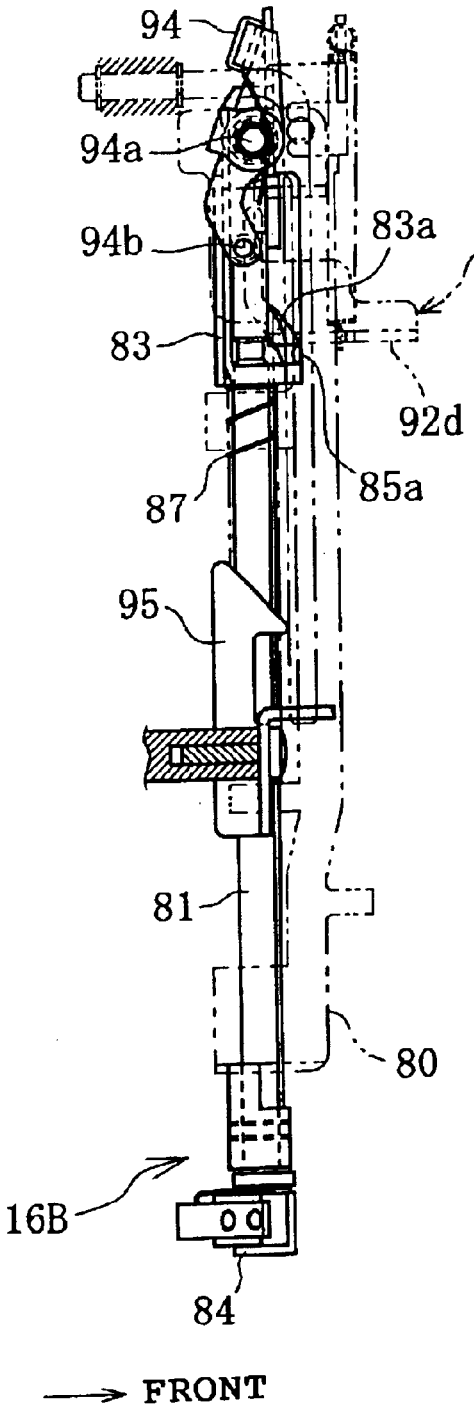
FIGS. 16A and 16B are left-hand side and front views of a threading mechanism respectively.
Figure 16B:
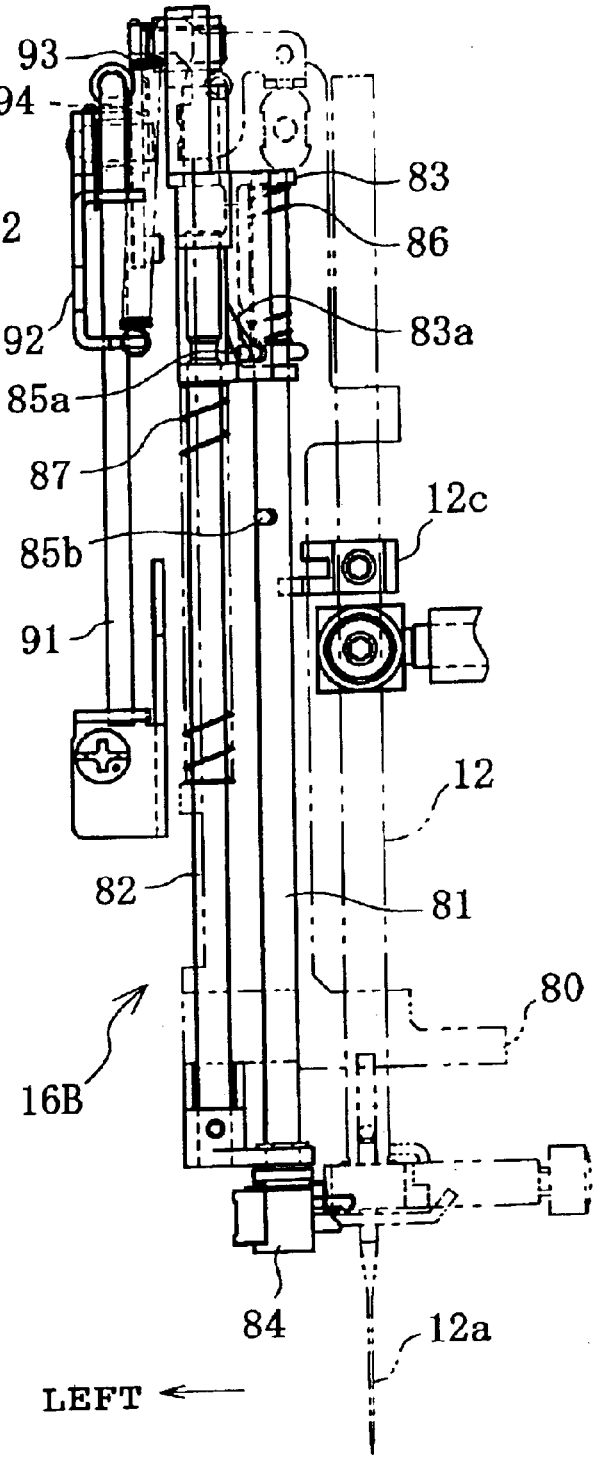
Figure 17A:
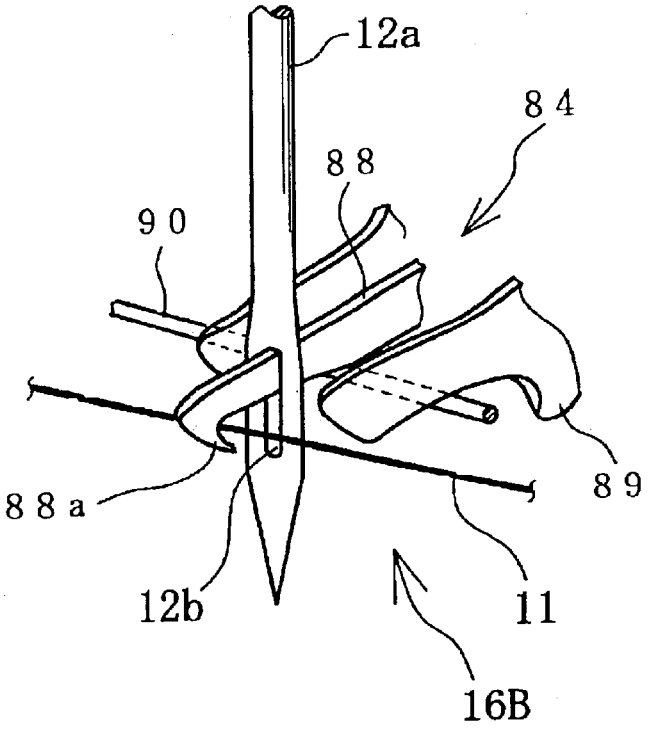
FIGS. 17A and 17B illustrate an operating state of the threading mechanism when a threading hook has been passed through the needle eye, and another operating state of the threading mechanism when the threading hook has been returned through the needle eye such that the thread has been passed through the needle eye, respectively.
Figure 17B:
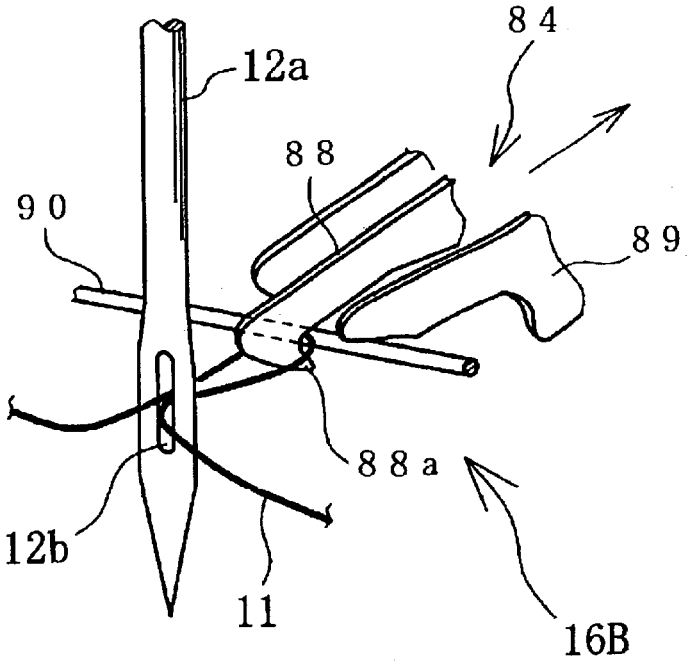

Referring to FIGS. 17A and 17B, the hook mechanism section 84 includes a threading hook 88 capable of passing through the needle eye 12*b* and having a distal end formed with a threading portion 88*a*, two guide members 89 located at both sides of the threading hook 88 respectively, and a wire 90 engageable with the threading portion 88*a* of the threading hook 88. The threading mechanism 16B is in the state as shown in FIGS. 16A and 16B when the thread cassette 10 is unattached to the cassette mount 5. When the thread cassette 10 is inserted into the cassette mount 5, the threading mechanism 16B is operated in synchronization with the attachment of the thread cassette 10.

The threading mechanism 16B further includes a longitudinal guide shaft 91 provided on the left of the slider guide shaft 82 and a moving member 92 provided on the cassette mount 5 to be guided by the guide shaft 91 so as to be vertically moved. The moving member 92 is urged upward by an extension coil spring 93. When the thread cassette 10 is unattached to the cassette mount 5, the moving member 92 is usually located at an initial position (an upper limit position in a movable range) as shown in FIGS. 16A and 16B.

The moving member 92 is directly thrust by the thread cassette 10 attached to the cassette mount 5. The threading mechanism 16B is operated when the moving member 92 is thrust downward from the initial position. More specifically, a connecting member 94 is pivotally mounted via a shaft 94*a* on an upper mounting portion 92*h* of the moving member 92. When the moving member 92 is descended from the initial position, the threading slider 83 connected via the connecting member 94 to the moving member 92 is also descended together.

When the threading slider 83 is descended, the threading shaft 81 and the hook mechanism 84 are also descended with the threading slider 83 at an initial stage. The threading shaft 81 is disallowed to be moved downward thereby to be stopped when the pin 85*b* thereof engages the engagement member 12*c* of the needle bar 12 from above, whereupon the threading shaft 81 is positioned in the vertical direction relative to the needle bar.

Subsequently, the threading slider 83 is descended relative to the threading shaft 81. Accordingly, the pin 85*a* engages the spiral engagement groove 83*a* of the threading slider 83 thereby to be moved upward, whereupon the threading shaft 81 is turned. At this time, the hook mechanism section 84 is located near the needle 12*a*, and moreover, the thread 11 drawn from the thread cassette 10 by the thread carrying mechanism 16A is carried near the needle 12*a*, held in front of the needle 12*a* in a stretched state. More specifically, when the threading shaft 81 is turned, the threading hook 88 of the hook mechanism 84 passes through the needle eye 12*b* as shown in FIG. 17A, so that the thread 11 is caught by the distal threading portion 88*a* of the threading hook 8 as shown in FIG. 17B. When the threading shaft 81 is then turned in the opposite direction, the threading hook 88 is returned through the needle eye 12*b* such that the thread 11 is passed through the needle eye 12*b*. At this time, the thread 11 is also placed on the needle bar thread guide H by the threading mechanism 17.

Approximately immediately after completion of passing the thread through the needle eye, the moving member 92 and the threading slider 83 are released from connection therebetween by the connecting member 94, whereupon the threading shaft 81, threading slider 83, hook mechanism section 84 are returned or ascended to the former conditions as shown in FIGS. 16A and 16B. Furthermore, the moving member 92 is maintained at a cassette attachment position below the initial position when the thread cassette 10 is attached to the cassette mount 5. More specifically, since the hook mechanism section 84 is spaced away from the moving member 92, transmission of force via the moving member 92 to the hook mechanism section 84 becomes impossible.

When a detaching operation member 60 is operated during power supply to the sewing machine, the thread cassette 10 located at the cassette attachment position and the moving member 92 are released from the held conditions and the thread cassette 10 is ascended together with the moving member 92 by the urging force of the extension coil spring 93. As a result, the upper portion of the thread cassette 10 projects from an upper part of the sewing machine M, whereby the thread cassette 10 can be detached from the cassette mount 5. Furthermore, the moving member 92 is ascended to be returned to the initial position. When returned to the initial position and thereafter descended from the initial position, the moving member 92 is connected to the threading slider 83 by the connecting member 94, whereupon the moving member and the connecting member are descended together.

Referring to FIG. 9, the cassette detaching mechanism 15 includes the detaching operation member 60 and a link 61 linked to the detaching operation member 60. When the detaching operation member 60 is operated to be rocked about the axis 60*a*, the link 61 is rocked together with the operation member 60 so that the thread cassette 10 located at the cassette attachment position and the moving member 92 are released from the held conditions. Furthermore, the thrusting member 51 is forced to be turned so that the discs 41 and 42 of the thread tensioning mechanism 14 are opened.

The needle bar 12 and the threading mechanism 16B are rocked. However, the thread carrying mechanism 16A is not rocked in such a manner as the needle bar 12 and the threading mechanism 16B are rocked. Accordingly, depending upon a zigzag position of the needle bar 12, positional relations between the needle bar 12 and threading mechanism 16B, and the thread carrying mechanism 16A vary depending upon a zigzag position of the needle bar 12. The percentage of success in passing the thread through the needle eye also varies depending upon the varying positional relations between the needle bar 12 and threading mechanism 16B, and the thread carrying mechanism 16A. When the thread carrying mechanism 16A and the threading mechanism 16B are rocked together, the weight of a rocked portion and a moving space defined inside the sewing machine M (escape) are increased, resulting in an increase in the size of the sewing machine M. Accordingly, the thread carrying mechanism 16A is not rocked together with the threading mechanism 16B in order that the size of the sewing machine M may be prevented from being increased.

The sewing machine M is constructed so that the thread 11 can reliably be passed through the needle eye 12*b* when the thread carrying mechanism 16A and threading mechanism 16B are operated while the needle bar 12 is stopped at a predetermined upper stop position and located at the left needle thread position (corresponding to the predetermined position). More specifically, the needle bar 12 is stopped at the upper stop position with the thread cassette 10 detached from the cassette mount 5 in order that the thread 11 may reliably be passed through the needle eye 12*b*. In this state, the thread cassette 10 needs to be attached to the cassette mount 5 and the thread carrying mechanism 16A and threading mechanism 16B needs to be operated.

Figure 13A:
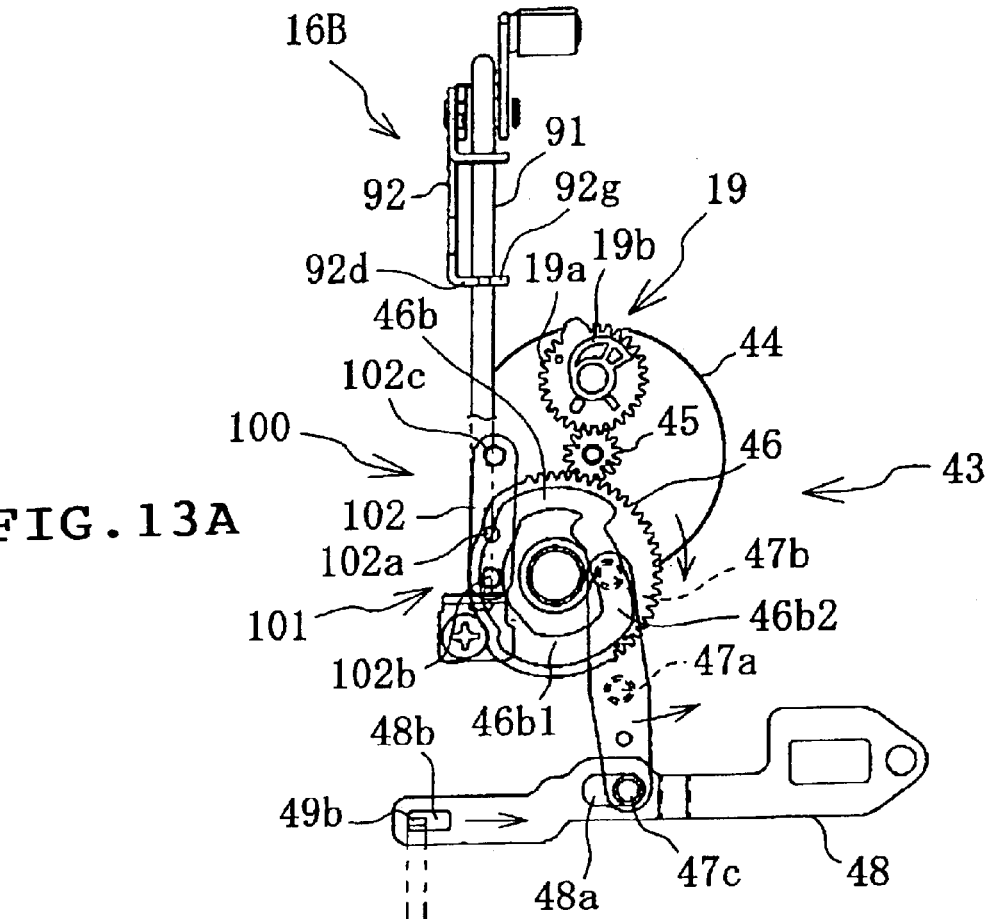
FIGS. 13A and 13B are front and plan views of a thread tensioning mechanism in an open state respectively.
Figure 14:
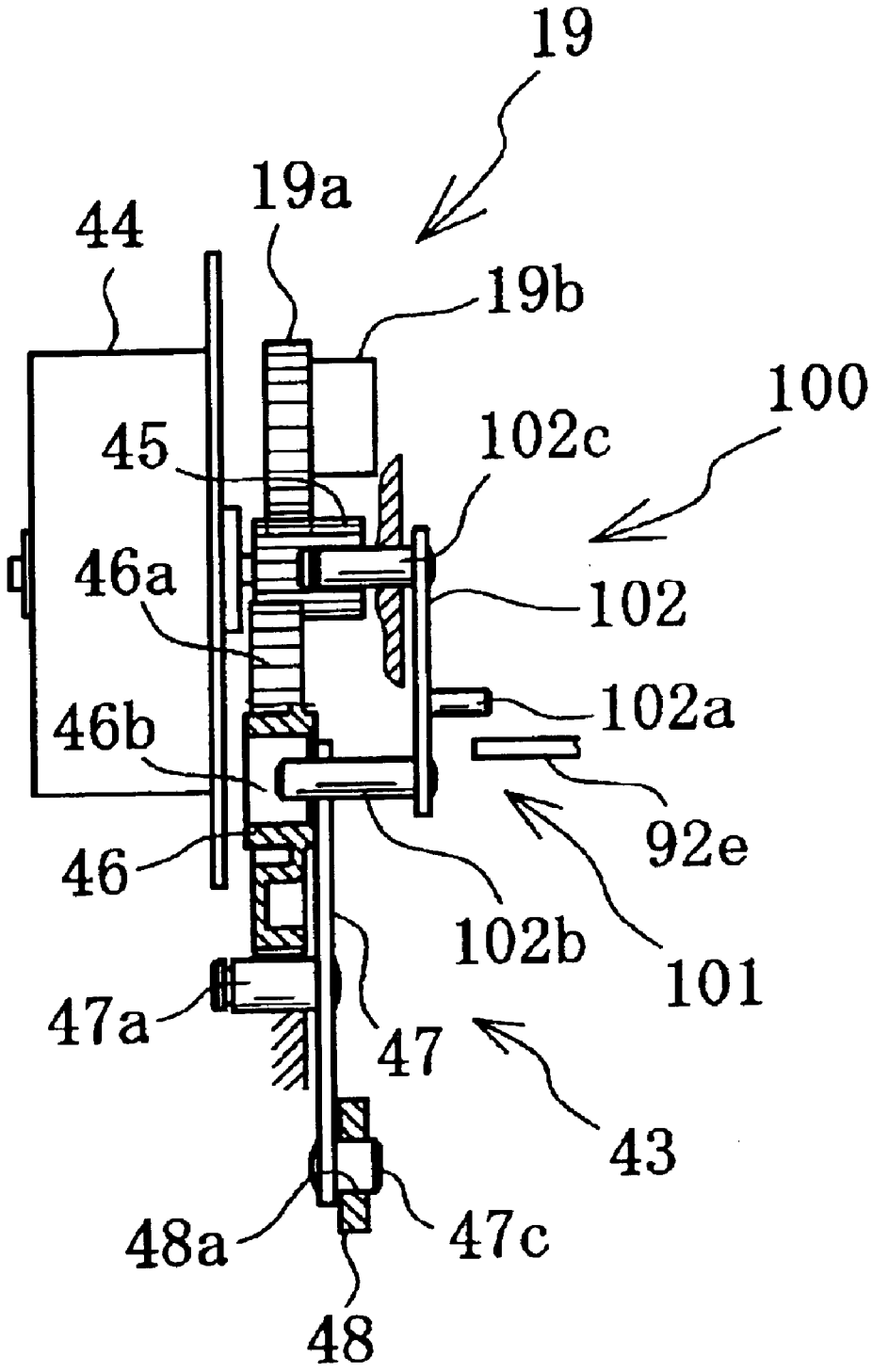
FIG. 14 is a view taken along line 14—14 in FIG. 12.

The sewing machine M is provided with a threading limiting mechanism 100 as shown in FIGS. 12A, 13A and 14. The threading limiting mechanism 100 limits the threading mechanism 16B so that the threading mechanism is inoperative or the threading mechanism does not draw the thread 11 from the thread cassette 10 in a case where the thread cassette 10 is detached from the cassette mount 5 and thereafter attached to the cassette mount while the machine is disconnected from a power supply (for example, when a power switch (not shown) is intentionally turned off or when a stoppage of power supply occurs due to the falling of a thunderbolt).

The threading limiting mechanism 100 includes a holding mechanism 101 holding the moving member 92 at a standby position where the threading mechanism 16B is inoperative even when the moving member 92 is thrust by the thread cassette 10 being attached to the cassette mount 5 thereby to be moved. The holding mechanism 101 includes a stopper 102 engaging the moving member 92 located at the standby position to hold the moving member at the standby position, the pulse motor 44 switching between an engagement position (see FIG. 12A) where the stopper 102 engages the moving member 92 and a non-engagement position (see FIG. 13A) where the stopper 102 is disallowed to engage the moving member 92, and a control device 110 controlling the pulse motor 44.

The stopper 102 is a vertically elongate link-like member and is provided near the front of the cam member 46. The stopper 102 has an upper end with a support 102*c* extending rearward. The support 102*c* is mounted on a frame disposed in the rear of the stopper 102 so as to pivot about an axis extending in a longitudinal axis. The stopper 102 has a lower end with a follower 102*b* extending rearward to be engaged with the cam groove 46*b* of the cam member 46 disposed in the rear of the stopper 102. The stopper 102 further includes an engagement pin 102*a* provided on a lengthwise central portion thereof. The engagement pin 102*a* extends forward to be engageable with the rear (an engaged portion 92*e*) of the moving member 92 disposed in front of the stopper 102.

Figure 18A:
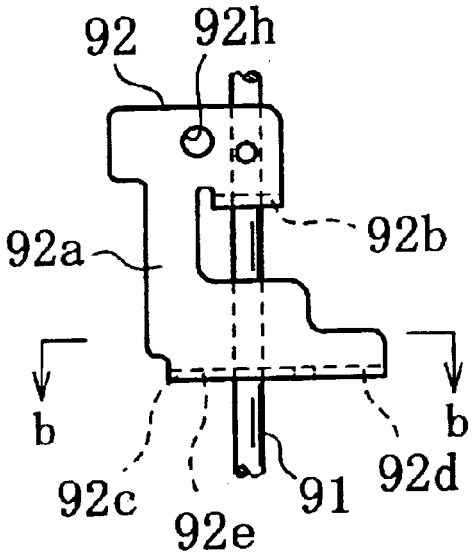
FIGS. 18A and 18B are a left-hand side view of a moving member and a view taken along line B—B in FIG. 18A, respectively.
Figure 18B:
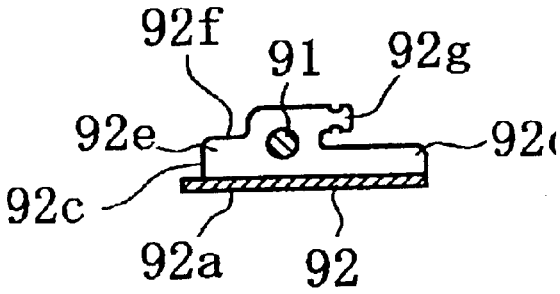

Referring to FIGS. 18A and 18B, the moving member 92 includes a vertical wall 92*a* and upper and lower horizontal strips 92*b* and 92*c* both extending rightward from the vertical wall. A guide shaft 91 extends through the horizontal strips 92*b* and 92*c* so as to be slid. A right front portion of the horizontal strip 92*c* relative to the guide shaft 91 serves as a thrust portion 92*d* thrust by the thread cassette 10 attached to the cassette mount 5. A rear portion of the horizontal strip 92*c* relative to the guide shaft 91 serves as the engaged portion 92*e* with which the engagement pin 102*a* is engageable. Furthermore, the horizontal strip 92*c* has a centrally located extended portion 92*g* with a rear end located in front of the engaged portion 92*e*.

The pulse motor 44 serves as a component of the needle bar rocking mechanism 18 to rock the needle bar 12 and as a drive source for opening and closing the thread tension discs 40 and 41. Thus, the pulse motor 44 serves for three mechanisms.

The cam groove 46*b* of the cam member 46 is shaped so that the stopper 102 is located at the non-engagement position and the thread tension discs 40 and 41 are open when the needle bar 12 is at the left needle thread position. The cam groove 46*b* of the cam member 46 is further shaped so that the stopper 102 is located at the engagement position and the thread tension discs 41 and 42 are closed when the needle bar 12 is located at a position other than the left needle thread position.

Figure 19:
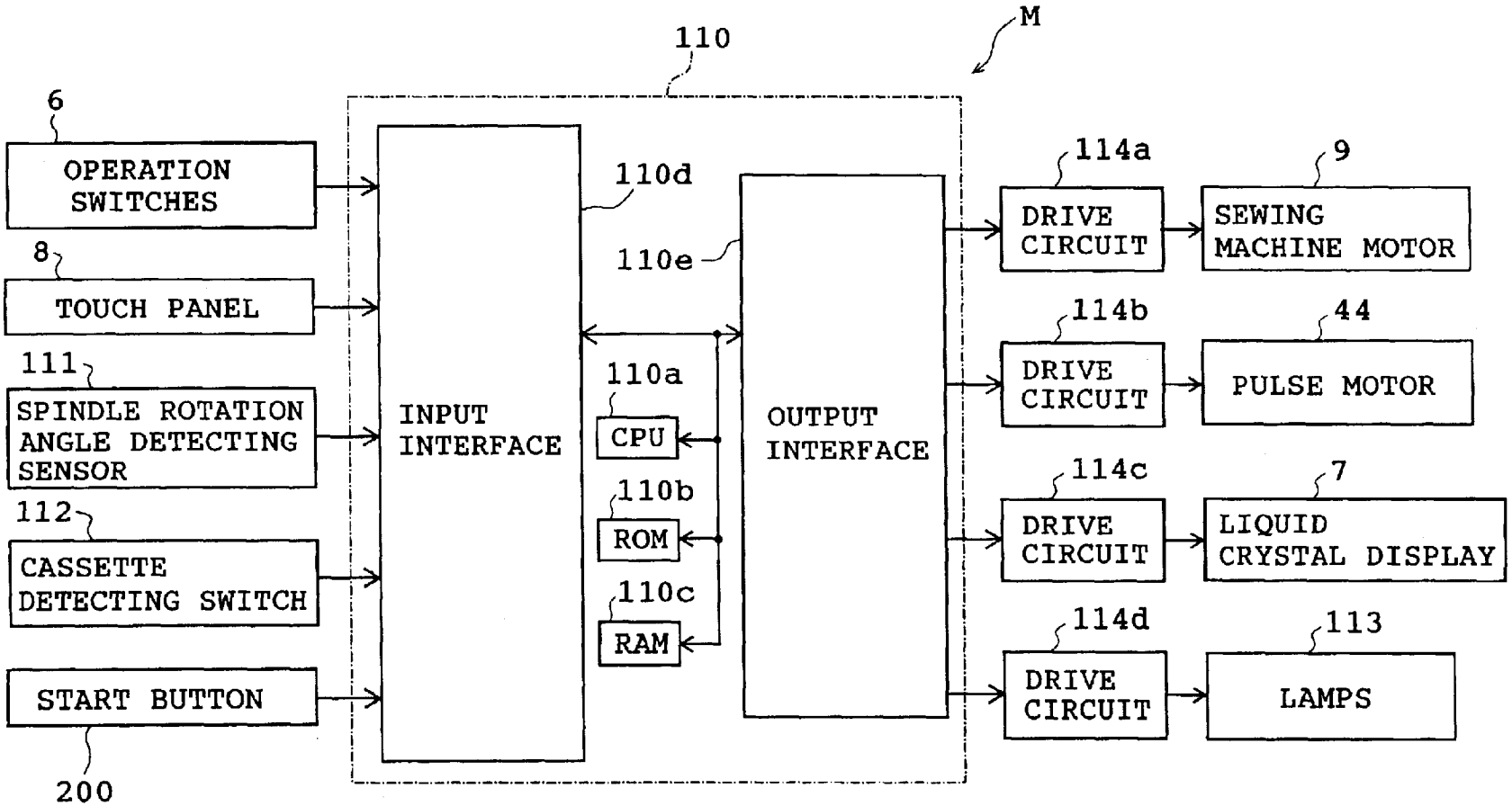
FIG. 19 is a block diagram showing a control system of the sewing machine.

The control system of the sewing machine M will be described. Referring to FIG. 19, the sewing machine M includes a control device 110 having CPU 110*a*, ROM 110*b*, RAM 110*c*, an input interface 110*d* and an output interface 110*e*. To the input interface 110*d* are electrically connected operating switches 6, the touch panel 8, spindle angle sensor 111, and cassette detecting switch 112. To the output interface 110*e* are electrically connected drive circuits 114*a* to 114*d* driving the sewing machine motor 9, pulse motor 44, liquid crystal display 7 and lamps 113 respectively.

The cassette detecting switch 112 detects the thread cassette 10 attached to the cassette mount 5 and comprises a limit switch, for example. The cassette detecting switch 112 is disposed near the lower end of the cassette mount 5 and turned on when the thread cassette 10 is attached to the cassette mount 5 and turned off when the thread cassette 10 is detached or slightly lifted up from the cassette mount 5.

Figure 20:
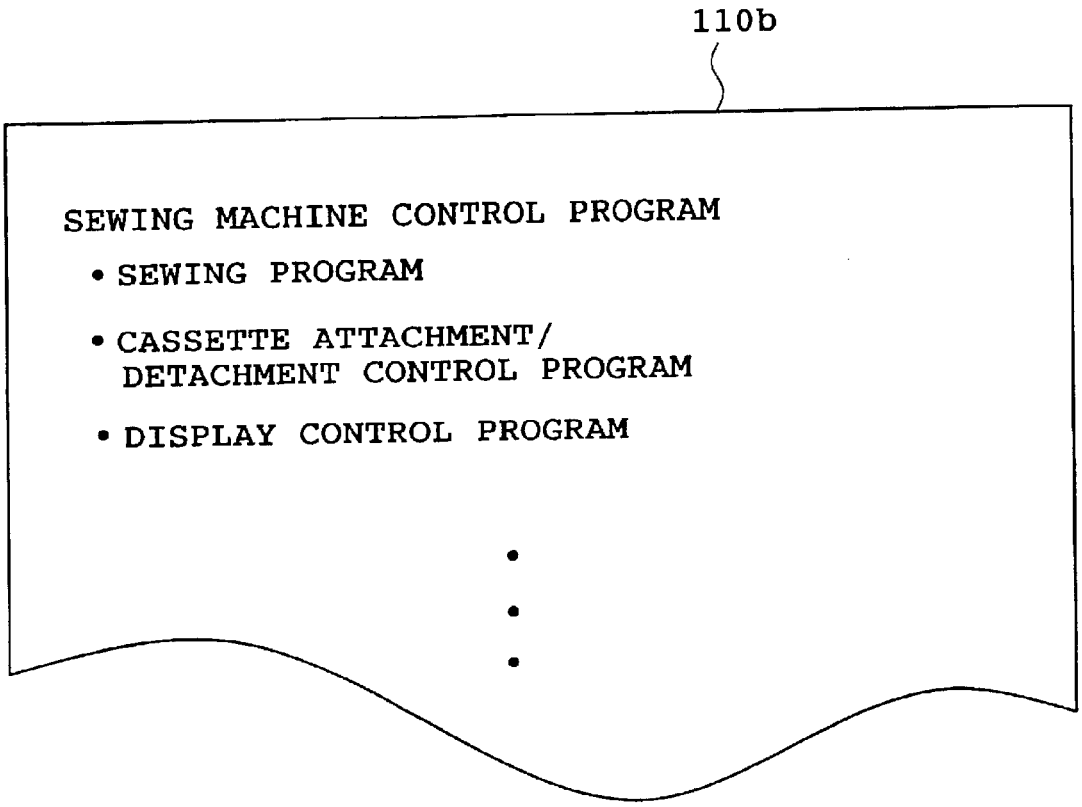
FIG. 20 illustrates a program stored by ROM in a control device.

ROM 110*b* stores a control program for the sewing machine M as shown in FIG. 20. The control program includes a sewing control program for the sewing operation, a cassette attachment and detachment control program for attaching and detaching the thread cassette 10 to and from the cassette mount 5, a display control program for displaying various pieces of information on the liquid crystal display 7, etc.

Figure 13B:
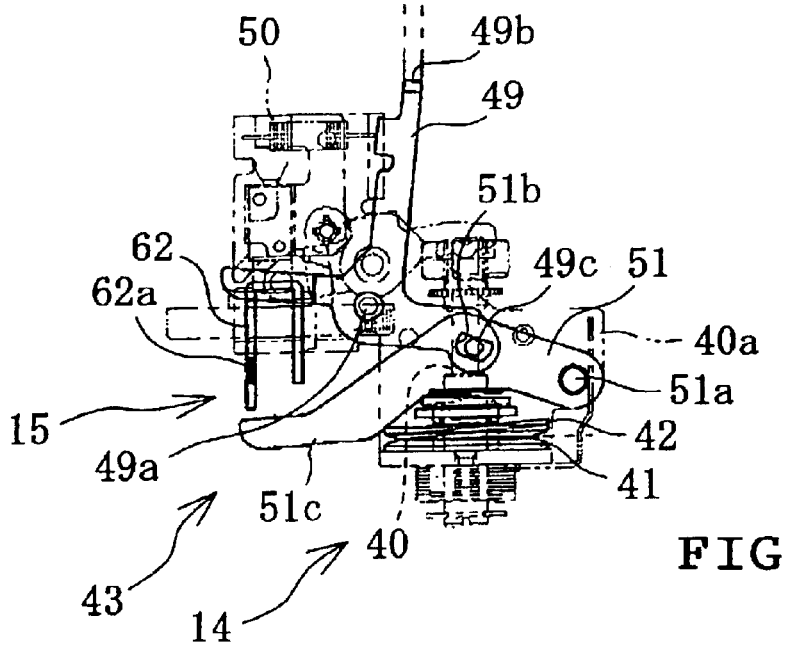

The following is a brief description of control carried out by the control device 110 on the basis of the cassette attachment and detachment control program. The control device 110 controls the sewing machine motor 9 and the pulse motor 44 on the basis of the results of detection of the spindle angle sensor 111, cassette detecting switch 112 and start button 200. The control device 110 controls the sewing machine motor 9 so that the needle bar 12 is automatically moved to the upper stop position when the cassette detecting switch 112 is turned off during detachment of the thread cassette 10 from the cassette mount 5. The control device 110 further controls the pulse motor 44 so that the cam member 46 is turned to the position as shown in FIGS. 13A and 13B and the needle bar 12 is moved to the left needle position, thereby opening the thread tension discs 41 and 42.

The sewing machine M operates as follows. The control device 110 controls the sewing machine motor 9 and pulse motor 44 when the thread cassette 10 is detached from the cassette mount 5 under the condition where electric power is being supplied to the sewing machine M. Consequently, the needle bar vertically moving mechanism 18 and the needle bar rocking mechanism 19 are operated so that the needle bar 12 is moved to the upper stop position and the left needle position (the predetermined position) Accordingly, when the thread cassette 10 is subsequently attached to the cassette mount 5, the threading mechanism 16B is operated so that the thread 11 drawn from the thread cassette 10 is automatically passed through the needle eye 12*b*. In other words, the needle eye 12*b* is moved to a predetermined threading position prior to detachment of the thread cassette 10.

On the other hand, the sewing machine motor 9 and the pulse motor 44 (and accordingly, the needle bar vertically moving mechanism 18 and the needle bar rocking mechanism 19) are inoperative when the sewing machine M is shut off from the power supply. Accordingly, the needle bar 12 cannot automatically be moved to the predetermined threading position even if when the thread cassette 10 has been detached from the cassette mount 5 during shutoff of the sewing machine M from the power supply. In some cases, the thread cassette 10 is then detached from the cassette mount 5 during the aforesaid shutoff, and the thread cassette 10 is re-attached to the cassette mount 5 after the needle bar 12 has been stopped at a position other than the predetermined threading position.

In the conventional sewing machines, as described above, the threading mechanism is operated in synchronization with attachment of the thread cassette 10 even when the thread cassette 10 is attached to the cassette mount 5 under the condition where the needle bar 12 is stopped at a position other than the predetermined threading position. In this case, however, since the needle bar 12 is not stopped at the predetermined position, passing the thread through the needle eye tends to fail, and the threading mechanism 16B tends to interfere with the thread carrying mechanism 16A or the like such that the threading mechanism 16B, the thread carrying mechanism 16A and the like would be damaged.

Figure 21A:
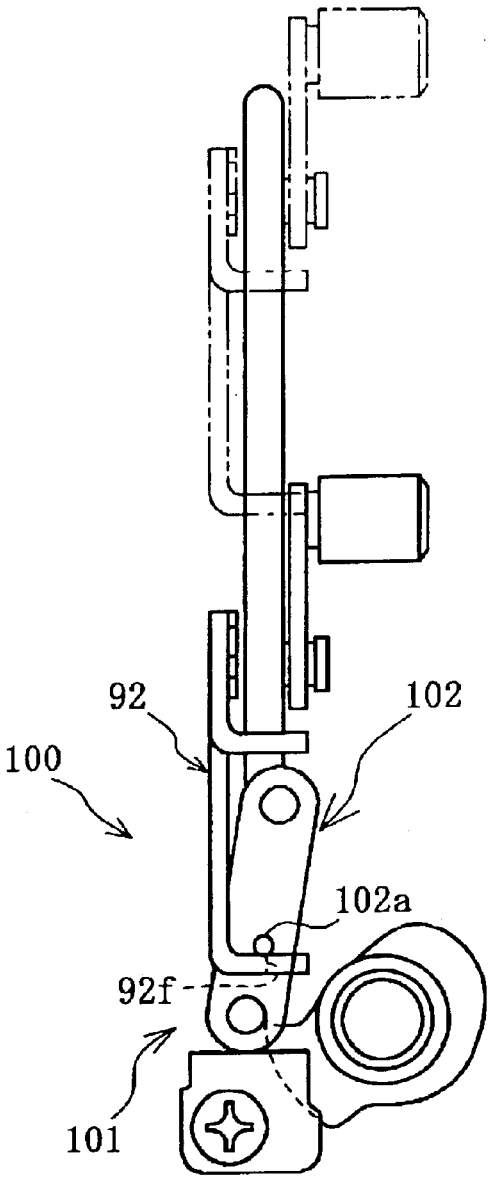
FIGS. 21A and 21B illustrate a stopper and a moving member when the stopper is located at an engagement position and FIGS. 21C and 21D illustrate the stopper and the moving member when the stopper is located at a non-engagement position.
Figure 21C:
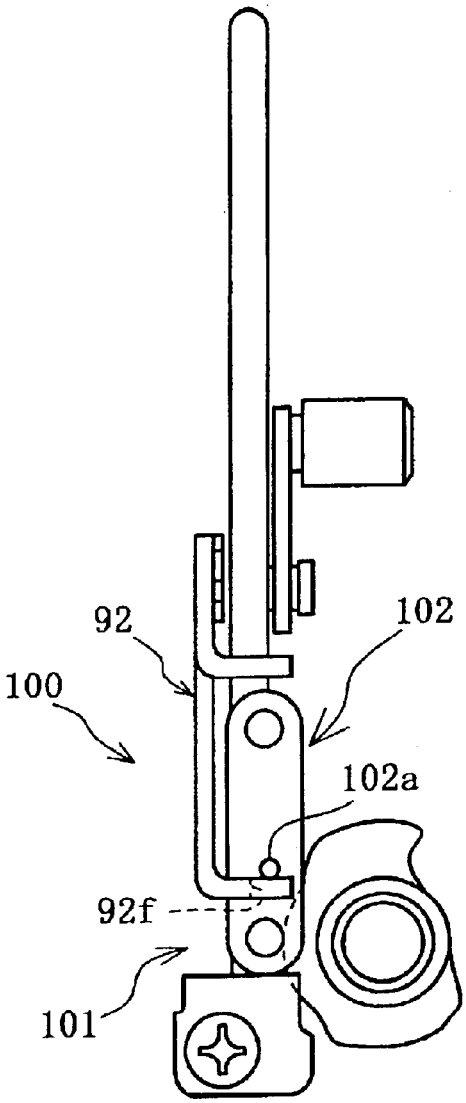
Figure 21B:
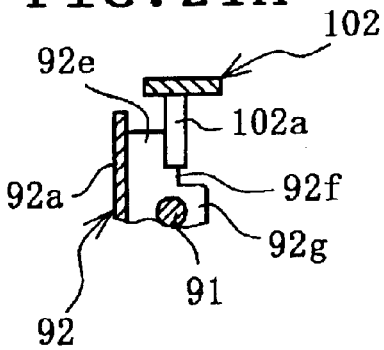
Figure 21D:
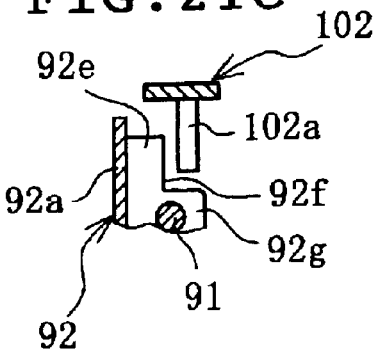

On the other hand, in the embodiment, the pulse motor 44 is driven to operate the cam member 46 and the like when the thread cassette 10 is attached to the cassette mount 5 and the detaching operation member 60 is subsequently operated after finish of the sewing during supply of electric power to the sewing machine M. Consequently, the stopper 102 is switched from the engagement position to the non-engagement position as shown in FIGS. 13A, 21C and 21D.

When the stopper 102 is located at the non-engagement position, the engagement pin 102*a* of the stopper is located above the engaged portion 92*e*, on the right of the rightmost end 92*f* (shown by broken line in FIG. 21C) of the engaged portion 92*e* and in the rear of the extended portion 92*g*. Accordingly, the engagement pin 102*a* is spaced away from the moving portion 92 such that the moving portion is released from the holding by the engagement pin. As a result, the spring force of the extension coil spring 93 raises the moving member 92 to the aforesaid initial position. When reaching the initial position, the moving member 92 is coupled to the hook mechanism section 84, whereby both moving member and hook mechanism section can be moved vertically together. In other words, the threading mechanism 16B is rendered operative with attachment of the thread cassette 10 to the cassette mount 5.

Subsequently, the thread cassette 10 is attached to the cassette mount 5 during supply of electric power to the sewing machine M. Upon operation of the start button 200 for start of the sewing, the pulse motor 44 is driven since the thread needs to be tensioned for the sewing. Consequently, the thread is tensioned by the thread tensioning mechanism 14. With rotation of the pulse motor 44 for the thread tensioning, the cam member 46 is operated so that the stopper 102 is switched from the non-engagement position to the engagement position as shown in FIGS. 12A, 21A and 21B. The stopper 102 is maintained at the engagement position while the thread is tensioned. The thread is not released from the tensioned state when the sewing has been completed. Accordingly, the thread tensioning mechanism 14 is still ready for tensioning the thread and the stopper 102 is located at the engagement position.

When the stopper 102 is located at the engagement position, the engagement pin 102*a* of the stopper is located right above the engaged portion 92*e*, on the left of the rightmost end 92*f* (shown by broken line in FIG. 21A) of the engaged portion 92*e*. Accordingly, in a case where the thread cassette 10 has been detached from the cassette mount 5, the engaged portion 92*e* abuts the underside of the engagement pin 102*a*, whereupon the moving member 92 cannot reach the upper stop position even when the spring force of the extension coil spring 93 raises the moving member 92. Since the moving member 92 is held by the engagement pin 102*a*, the moving member 92 remains spaced away from the hook mechanism section 84.

The sewing machine M is shut off from the power supply while the thread cassette 10 is attached to the cassette mount and the thread is tensioned by the thread tension determining mechanism 14. When the detaching operation member 60 is operated during shutoff of the sewing machine M from the power supply, the thread cassette 10 is detached from the cassette mount 5. The pulse motor 44 cannot be operated since the sewing machine M has been shut off from the power supply. In other words, the stopper 102 cannot be switched from the engagement position to the non-engagement position by the pulse motor 44 as shown in FIGS. 13A, 21C and 21D. Furthermore, since the moving member 92 and the hook mechanism section 84 are separated away from each other, the hook mechanism section is not descended even when the thread cassette 10 is attached to the cassette mount 5.

The needle bar vertically moving mechanism 18 and the needle bar rocking mechanism 19 cannot be operated by the sewing machine motor 9 and the pulse motor 44 since the sewing machine M is shut off from the power supply. On the other hand, even in a case where the moving member 92 and the hook mechanism section 84 are separated away from each other, the thread carrying mechanism 16A is operated when the thread cassette 10 is attached to the cassette mount 5. As a result, a part of the mechanism is descended near the needle eye 12*b*. The needle eye 12*b* is not always located at a position suitable for thread passing when the sewing machine M is shut off from the power supply and accordingly stopped. Furthermore, even when the needle eye 12*b* is located at a position suitable for the thread passing immediately after shutoff from power supply, a hand pulley (not shown) provided on the sewing machine M is operated so that the location of the needle eye 12*b* is manually changed vertically. As a result, the position of the needle eye 12*b* would be unsuitable for the thread passing.

In the sewing machine M of the embodiment, however, the thread cassette 10 is detached from the cassette mount 5 when the sewing machine is shut off from the power supply. Thereafter, when the thread cassette 10 is attached to the cassette mount 5 during the shutoff, the threading limiting mechanism 100 limits the threading mechanism so that the threading mechanism is inoperative. Thus, the threading mechanism 16B is inoperative even when the thread cassette 10 is erroneously attached to the cassette mount 5 although the needle bar 12 is not stopped at the predetermined position. Consequently, the threading mechanism 16B and other mechanisms or components can be prevented from being damaged.

In the above-described construction of the sewing machine M, the threading mechanism 16B is operated by thrusting the moving member 92 from the initial position by the thread cassette 10 attached to the cassette mount 5. However, since the moving member 92 is held at the standby position by the holding mechanism 101 of the threading limiting mechanism 100, the threading mechanism 16B can be rendered inoperative even when the moving member 92 is thrust by the thread cassette 10 attached to the cassette mount 5. Consequently, since the thread 11 is not drawn from the thread cassette 10 by the threading mechanism 16B, the thread 11 can be prevented from being rewound and accordingly, the usability of the sewing machine can be improved.

The holding mechanism 101 includes the stopper 102, pulse motor 44 and control device 110. The control device 110 controls the pulse motor 44 so that the stopper 102 is switched between the engagement position and the non-engagement position. In this case, the stopper 102, when located at the engagement position, engages the moving member 92 located at the standby position, whereupon the moving member 92 can be maintained at the standby position under the condition where electric power is being supplied to the sewing machine M. When the stopper 102 is located at the non-engagement position, the moving member 92 can be returned to the initial position.

The stopper 102 is switched by the pulse motor 44 between the engagement position and the non-engagement position. Furthermore, the needle bar 12 is rocked via the needle bar rocking mechanism 19. Consequently, the number of actuators can be reduced. This is advantageous for synchronous operation of various mechanisms. Furthermore, the stopper 102 is located at the engagement position when the needle bar 12 is located at a position other than the foregoing predetermined position. Consequently, the moving member 92 can be maintained at the standby position.

The pulse motor 44 serves to switch the stopper 102 between the engagement and non-engagement positions, to rock the needle bar 12 by means of the needle bar rocking mechanism 19 and to open and close the thread tension discs 41 and 42 tensioning the thread 11 drawn from the thread cassette 10. Consequently, the number of actuators can further be reduced. This is further advantageous for synchronous operations of the mechanisms.

Modified forms of the foregoing embodiment will now be described. The thread cassette 10 is a mere example and accordingly, the thread cassette should not be limited to the one including a supply of thread comprising a thread spool or the like on which a thread is wound up. The thread cassette may comprise a storing section in which a lump of thread serving as a supply of thread is stored. Furthermore, at least one of walls covering the thread storing section may be eliminated and a thread spool may be held on a holding section such as a spool pin.

The moving member 92 can be moved downward to some extent by the thread cassette 10 attached to the cassette mount 5 whether or not the sewing machine M is connected to the power supply. However, the moving member 92 may be disallowed to be moved downward when the sewing machine M is shut off from the power supply. Furthermore, it is considered that an excessively large force is applied in the abutment of the thread cassette 10 against the moving member 92. However, when the thread cassette 10 abuts the moving member 92 such that the moving member is moved downward against the urging force of the spring 93, a buffering or shock absorbing function is obtained for prevention of damage in the moving member 92 and thread cassette 10.

A stopper mechanism may be provided on a movement path of the thread cassette 10 for preventing downward movement of the thread cassette in order that the moving member may be prevented from being thrust by the thread cassette when the thread cassette is attached to the cassette mount during the shutoff of the sewing machine from the power supply. The stopper mechanism may comprise a solenoid actuator, for example. The solenoid actuator may be controlled so that the stopper is retreated from the movement path while electric power is being supplied to the sewing machine M and so that the stopper is protruded from the movement path while the sewing machine M is shut off from the power supply. Consequently, the thread 11 can be prevented from being drawn uselessly by the sewing machine M (the thread carrying mechanism 16A, threading mechanism 16B, thread tensioning mechanism 14 and needle thread take-up lever 3).

The thread carrying mechanism 16A is operated even when the thread cassette 10 is attached to the cassette mount 5 under the condition where the moving member 92 and the hook mechanism section 84 are spaced away from each other. As a result, a part of the thread carrying mechanism 16A is descended near the needle eye 12*b*. However, a second stopper such as the stopper 102 for the moving member 92 may be provided to render the thread carrying mechanism 16A inoperative even when the thread cassette 10 is attached to the cassette mount 5 during shutoff of the sewing machine from the power supply. Furthermore, the thread carrying mechanism 16A may be provided with an electric motor rendering the mechanism inoperative even when the thread cassette 10 is attached to the cassette mount 5 during shutoff of the sewing machine from the power supply. Thus, the thread 11 can be prevented from being drawn uselessly when the thread carrying mechanism 16A is constructed so as to be rendered inoperative even when the thread cassette 10 is attached to the cassette mount 5 during the shutoff. Consequently, the usability of the sewing machine M can be improved. Additionally, the threading limiting mechanism 100 may be provided in a sewing apparatus which includes the threading mechanism 16B but does not include the thread carrying mechanism 16A.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A sewing apparatus comprising:

a needle bar on which a sewing needle is mounted;

a needle bar vertically moving mechanism vertically moving the needle bar;

a thread cassette having a thread accommodating section accommodating a supply of thread;

a cassette mount to which the thread cassette is detachably attached;

a threading mechanism operated in synchronization with attachment of the thread cassette to the cassette mount when the needle bar is stopped at a predetermined position, the threading mechanism passing the thread drawn from the thread cassette through an eye of the needle mounted on the needle bar; and a threading limiting unit limiting the threading mechanism so that the threading mechanism is inoperative in a case where the thread cassette is attached to the cassette mount when the apparatus is disconnected from a power supply.

2. A sewing apparatus according to claim 1, further comprising a needle bar rocking mechanism for rocking the needle bar and a needle bar movement controlling unit controlling the needle bar vertically moving mechanism and the needle bar rocking mechanism so that the needle bar is moved to the predetermined position in a case where the thread cassette has been detached from the cassette mount while electric power is being supplied to the apparatus.

3. A sewing apparatus according to claim 1, further comprising a needle bar movement controlling unit controlling the needle bar vertically moving mechanism so that the needle bar is moved to the predetermined position in a case where the thread cassette has been detached from the cassette mount while electric power is being supplied to the apparatus.

4. A sewing apparatus according to claim 1, wherein the threading mechanism includes a moving member provided on the cassette mount, the moving member being thrust by the thread cassette attached to the cassette mount thereby to be moved from an initial position so that the threading mechanism is operated, and the threading mechanism includes a holding unit holding the moving member at a standby position where the threading mechanism is inoperative even when the moving member is thrust by the thread cassette being attached to the cassette mount.

5. A sewing apparatus according to claim 4, wherein the holding unit includes a stopper engaging the moving member located at the standby position to hold the moving member at the standby position, an actuator switching between an engagement position where the stopper engages the moving member and a non-engagement position where the stopper is disallowed to engage the moving member, and a control unit controlling the actuator.

6. A sewing apparatus according to claim 5, wherein the actuator comprises a pulse motor provided in the needle bar vertically moving mechanism for rocking the needle bar, and the threading limiting unit limits the threading mechanism so that the stopper is located at the non-engagement position when the needle bar is located at the predetermined position and so that the stopper is located at the engagement position when the needle bar is located at a position other than the predetermined position.

7. A sewing apparatus according to claim 6, wherein the pulse motor also serves to open and close a thread tension disc applying a tension to the thread drawn from the thread cassette, and the thread tension disc is opened when the needle bar is located at the predetermined position and closed when the needle bar is located at a position other than the predetermined position.

8. A sewing apparatus comprising:

a needle bar on which a sewing needle is mounted;

a needle bar vertically moving mechanism vertically moving the needle bar;

a thread cassette having a thread accommodating section accommodating a supply of thread;

a cassette mount to which the thread cassette is detachably attached;

a thread carrying mechanism operated in synchronization with attachment of the thread cassette to the cassette mount when the needle bar is stopped at the predetermined position, thereby carrying the thread from the thread cassette to a position near an eye of the needle mounted on the needle bar;

a threading mechanism operated in synchronization with attachment of the thread cassette to the cassette mount when the needle bar is stopped at the predetermined position, the threading mechanism passing the thread drawn from the thread cassette through the needle eye; and a limiting unit limiting the threading mechanism and the thread carrying mechanism so that both the threading mechanism and the thread carrying mechanism are inoperative in a case where the thread cassette is attached to the cassette mount when the apparatus is disconnected from a power supply.

* * * * *